US008910640B2

(12) United States Patent
Sears et al.

(10) Patent No.: US 8,910,640 B2
(45) Date of Patent: Dec. 16, 2014

(54) WICK SUITABLE FOR USE IN AN ELECTRONIC SMOKING ARTICLE

(71) Applicant: R.J. Reynolds Tobacco Company, Winston-Salem, NC (US)

(72) Inventors: Steven Benson Sears, Siler City, NC (US); Grady Lance Dooly, Winston-Salem, NC (US); David William Griffith, Jr., Winston-Salem, NC (US); Andries Don Sebastian, Clemmons, NC (US); Yi-Ping Chang, Greensboro, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 13/754,324

(22) Filed: Jan. 30, 2013

(65) Prior Publication Data

US 2014/0209105 A1 Jul. 31, 2014

(51) Int. Cl.
*A24F 47/00* (2006.01)

(52) U.S. Cl.
CPC ..... *A24F 47/008* (2013.01)
USPC ..... 131/273; 131/194; 128/202.21; 392/395

(58) Field of Classification Search
USPC ..... 392/390, 395; 422/125; 128/200.14–200.23, 202.21, 203.26, 128/204.13; 126/358.1; 239/44–51.5
See application file for complete search history.

(56) References Cited

U.S. PATENT DOCUMENTS

| | | | |
|---|---|---|---|
| 1,771,366 | A | 7/1930 | Wyss et al. |
| 2,057,353 | A | 10/1936 | Whittemore, Jr. |
| 2,104,266 | A | 1/1938 | McCormick |
| 2,805,669 | A | 9/1957 | Meriro |
| 3,200,819 | A | 4/1963 | Gilbert |
| 3,398,754 | A | 6/1966 | Tughan |
| 3,316,919 | A | 5/1967 | Green et al. |
| 3,419,015 | A | 12/1968 | Wochnowski |
| 3,424,171 | A | 1/1969 | Rooker |
| 3,476,118 | A | 11/1969 | Luttich |
| 4,054,145 | A | 10/1977 | Berndt et al. |
| 4,131,117 | A | 12/1978 | Kite et al. |
| 4,150,677 | A | 4/1979 | Osborne |
| 4,190,046 | A | 2/1980 | Virag |
| 4,219,032 | A | 8/1980 | Tabatznik et al. |
| 4,259,970 | A | 4/1981 | Green, Jr. |
| 4,284,089 | A | 8/1981 | Ray |
| 4,303,083 | A | 12/1981 | Burruss, Jr. |
| 4,449,541 | A | 5/1984 | Mays et al. |
| 4,506,682 | A | 3/1985 | Muller |
| 4,635,651 | A | 1/1987 | Jacobs |

(Continued)

FOREIGN PATENT DOCUMENTS

| | | |
|---|---|---|
| AU | 276250 | 7/1965 |
| CA | 2 641 869 | 5/2010 |

(Continued)

*Primary Examiner* — Richard Crispino
*Assistant Examiner* — Eric Yaary
(74) *Attorney, Agent, or Firm* — Womble Carlyle Sandridge Sandridge & Rice, LLP

(57) ABSTRACT

The present disclosure relates to an electronic smoking article that provides for improved aerosol delivery. Particularly, the article comprises a wicking element useful for improving delivery of aerosol precursor to a heating element. In particular, the wick can take on a brush-like configuration. The present disclosure further relates to methods of forming an aerosol in a smoking article.

36 Claims, 10 Drawing Sheets

(56) References Cited

U.S. PATENT DOCUMENTS 4,674,519 A 6/1987 Keritsis et al.
4,708,151 A 11/1987 Shelar
4,714,082 A 12/1987 Banerjee et al.
4,735,217 A 4/1988 Gerth et al.
4,756,318 A 7/1988 Clearman et al.
4,771,795 A 9/1988 White et al.
4,776,353 A 10/1988 Lilja et al.
4,793,365 A 12/1988 Sensabaugh, Jr. et al.
4,800,903 A 1/1989 Ray et al.
4,819,665 A 4/1989 Roberts et al.
4,821,749 A 4/1989 Toft et al.
4,830,028 A 5/1989 Lawson et al.
4,836,224 A 6/1989 Lawson et al.
4,836,225 A 6/1989 Sudoh
4,848,374 A 7/1989 Chard et al.
4,848,376 A 7/1989 Lilja et al.
4,874,000 A 10/1989 Tamol et al.
4,880,018 A 11/1989 Graves, Jr. et al.
4,887,619 A 12/1989 Burcham, Jr. et al.
4,907,606 A 3/1990 Lilja et al.
4,913,168 A 4/1990 Potter et al.
4,917,119 A * 4/1990 Potter et al. ..... 131/273
4,917,128 A 4/1990 Clearman et al.
4,922,901 A 5/1990 Brooks et al.
4,924,888 A 5/1990 Perfetti et al.
4,928,714 A 5/1990 Shannon
4,938,236 A 7/1990 Banerjee et al.
4,941,483 A 7/1990 Ridings et al.
4,941,484 A 7/1990 Clapp et al.
4,945,931 A 8/1990 Gori
4,947,874 A 8/1990 Brooks et al.
4,947,875 A 8/1990 Brooks et al.
4,972,854 A 11/1990 Kiernan et al.
4,972,855 A 11/1990 Kuriyama et al.
4,986,286 A 1/1991 Roberts et al.
4,987,906 A 1/1991 Young et al.
5,005,593 A 4/1991 Fagg
5,019,122 A 5/1991 Clearman et al.
5,022,416 A 6/1991 Watson
5,042,510 A 8/1991 Curtiss et al.
5,056,537 A 10/1991 Brown et al.
5,060,669 A 10/1991 White et al.
5,060,671 A 10/1991 Counts et al.
5,065,775 A 11/1991 Fagg
5,072,744 A 12/1991 Luke et al.
5,074,319 A 12/1991 White et al.
5,076,296 A 12/1991 Nystrom et al.
5,093,894 A 3/1992 Deevi et al.
5,095,921 A 3/1992 Losee et al.
5,097,850 A 3/1992 Braunshteyn et al.
5,099,862 A 3/1992 White et al.
5,099,864 A 3/1992 Young et al.
5,103,842 A 4/1992 Strang et al.
5,121,757 A 6/1992 White et al.
5,129,409 A 7/1992 White et al.
5,131,415 A 7/1992 Munoz et al.
5,143,097 A 9/1992 Sohn et al.
5,144,962 A 9/1992 Counts et al.
5,146,934 A 9/1992 Deevi et al.
5,159,940 A 11/1992 Hayward et al.
5,159,942 A 11/1992 Brinkley et al.
5,179,966 A 1/1993 Losee et al.
5,211,684 A 5/1993 Shannon et al.
5,220,930 A 6/1993 Gentry
5,224,498 A 7/1993 Deevi et al.
5,228,460 A 7/1993 Sprinkel, Jr. et al.
5,230,354 A 7/1993 Smith et al.
5,235,992 A 8/1993 Sensabaugh
5,243,999 A 9/1993 Smith
5,246,018 A 9/1993 Deevi et al.
5,249,586 A 10/1993 Morgan et al.
5,261,424 A 11/1993 Sprinkel, Jr.
5,269,327 A 12/1993 Counts et al.
5,285,798 A 2/1994 Banerjee et al.
5,293,883 A 3/1994 Edwards
5,301,694 A 4/1994 Raymond et al.
5,303,720 A 4/1994 Banerjee et al.
5,318,050 A 6/1994 Gonzalez-Parra et al.
5,322,075 A 6/1994 Deevi et al.
5,322,076 A 6/1994 Brinkley et al.
5,339,838 A 8/1994 Young et al.
5,345,951 A 9/1994 Serrano et al.
5,353,813 A 10/1994 Deevi et al.
5,357,984 A 10/1994 Farrier et al.
5,360,023 A 11/1994 Blakley et al.
5,369,723 A 11/1994 Counts et al.
5,372,148 A 12/1994 McCafferty et al.
5,377,698 A 1/1995 Litzinger et al.
5,388,574 A 2/1995 Ingebrethsen et al.
5,388,594 A 2/1995 Counts et al.
5,408,574 A 4/1995 Deevi et al.
5,435,325 A 7/1995 Clapp et al.
5,445,169 A 8/1995 Brinkley et al.
5,468,266 A 11/1995 Bensalem et al.
5,468,936 A 11/1995 Deevi et al.
5,479,948 A 1/1996 Counts et al.
5,498,850 A 3/1996 Das
5,498,855 A 3/1996 Deevi et al.
5,499,636 A 3/1996 Baggett, Jr. et al.
5,501,237 A 3/1996 Young et al.
5,505,214 A 4/1996 Collins et al.
5,530,225 A 6/1996 Hajaligol
5,551,450 A 9/1996 Hemsley
5,551,451 A 9/1996 Riggs et al.
5,564,442 A 10/1996 MacDonald et al.
5,573,692 A 11/1996 Das et al.
5,591,368 A 1/1997 Fleischhauer et al.
5,593,792 A 1/1997 Farrier et al.
5,595,577 A 1/1997 Bensalem et al.
5,596,706 A 1/1997 Sikk et al.
5,611,360 A 3/1997 Tang
5,613,504 A 3/1997 Collins et al.
5,613,505 A 3/1997 Campbell et al.
5,649,552 A 7/1997 Cho et al.
5,659,656 A 8/1997 Das
5,665,262 A 9/1997 Hajaligol et al.
5,666,976 A 9/1997 Adams et al.
5,666,977 A 9/1997 Higgins et al.
5,666,978 A 9/1997 Counts et al.
5,687,746 A * 11/1997 Rose et al. ..... 131/273
5,692,525 A 12/1997 Counts et al.
5,692,526 A 12/1997 Adams et al.
5,708,258 A 1/1998 Counts et al.
5,711,320 A 1/1998 Martin
5,726,421 A 3/1998 Fleischhauer et al.
5,727,571 A 3/1998 Meiring et al.
5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt
5,829,453 A 11/1998 White et al.
5,865,185 A 2/1999 Collins et al.
5,865,186 A 2/1999 Volsey, II
5,878,752 A 3/1999 Adams et al.
5,880,439 A 3/1999 Deevi et al.
5,915,387 A 6/1999 Baggett, Jr. et al.
5,934,289 A 8/1999 Watkins et al.
5,954,979 A 9/1999 Counts et al.
5,967,148 A 10/1999 Harris et al.
6,026,820 A 2/2000 Baggett, Jr. et al.
6,033,623 A 3/2000 Deevi et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,116,247 A 9/2000 Banyasz et al.
6,119,700 A 9/2000 Fleischhauer et al.
6,125,853 A 10/2000 Susa et al.
6,125,855 A 10/2000 Nevett et al.
6,125,866 A 10/2000 Nichols et al.
6,155,268 A 12/2000 Takeuchi
6,164,287 A 12/2000 White
6,182,670 B1 2/2001 White

(56) References Cited

U.S. PATENT DOCUMENTS

| | | | | |
|---|---|---|---|---|
| 6,196,218 | B1 | 3/2001 | Voges | |
| 6,216,706 | B1 | 4/2001 | Kumar et al. | |
| 6,289,898 | B1 | 9/2001 | Fournier et al. | |
| 6,349,728 | B1 | 2/2002 | Pham | |
| 6,357,671 | B1 | 3/2002 | Cewers | |
| 6,418,938 | B1 | 7/2002 | Fleischhauer et al. | |
| 6,446,426 | B1 | 9/2002 | Sweeney et al. | |
| 6,532,965 | B1 | 3/2003 | Abhulimen et al. | |
| 6,598,607 | B2 | 7/2003 | Adiga et al. | |
| 6,601,776 | B1 | 8/2003 | Oljaca et al. | |
| 6,615,840 | B1 | 9/2003 | Fournier et al. | |
| 6,688,313 | B2 | 2/2004 | Wrenn et al. | |
| 6,701,936 | B2 | 3/2004 | Shafer et al. | |
| 6,715,494 | B1 | 4/2004 | McCoy | |
| 6,730,832 | B1 | 5/2004 | Dominguez et al. | |
| 6,772,756 | B2 | 8/2004 | Shayan | |
| 6,803,545 | B2 | 10/2004 | Blake et al. | |
| 6,803,550 | B2 | 10/2004 | Sharpe et al. | |
| 6,810,883 | B2 | 11/2004 | Felter et al. | |
| 6,854,461 | B2 | 2/2005 | Nichols et al. | |
| 6,854,470 | B1 | 2/2005 | Pu | |
| 6,994,096 | B2 | 2/2006 | Rostami et al. | |
| 7,011,096 | B2 | 3/2006 | Li et al. | |
| 7,017,585 | B2 | 3/2006 | Li et al. | |
| 7,025,066 | B2 | 4/2006 | Lawson et al. | |
| 7,117,867 | B2 | 10/2006 | Cox et al. | |
| 7,163,015 | B2 | 1/2007 | Moffitt | |
| 7,173,322 | B2 | 2/2007 | Sakata et al. | |
| 7,185,659 | B2 | 3/2007 | Sharpe et al. | |
| 7,234,470 | B2 | 6/2007 | Yang | |
| 7,290,549 | B2 | 11/2007 | Banerjee et al. | |
| 7,293,565 | B2 | 11/2007 | Griffin et al. | |
| 7,392,809 | B2 | 7/2008 | Larson et al. | |
| 7,513,253 | B2 | 4/2009 | Kobayashi et al. | |
| 7,647,932 | B2 | 1/2010 | Cantrell et al. | |
| 7,690,385 | B2 | 4/2010 | Moffitt | |
| 7,692,123 | B2 | 4/2010 | Baba et al. | |
| 7,726,320 | B2 | 6/2010 | Robinson et al. | |
| 7,810,505 | B2 | 10/2010 | Yang | |
| 7,832,410 | B2 | 11/2010 | Hon | |
| 7,878,209 | B2 | 2/2011 | Newbery et al. | |
| 7,896,006 | B2 | 3/2011 | Hamano et al. | |
| 8,066,010 | B2 | 11/2011 | Newbery et al. | |
| 8,079,371 | B2 | 12/2011 | Robinson et al. | |
| 2002/0146242 | A1* | 10/2002 | Vieira | 392/395 |
| 2003/0131859 | A1 | 7/2003 | Li et al. | |
| 2003/0226837 | A1 | 12/2003 | Blake et al. | |
| 2004/0020500 | A1 | 2/2004 | Wrenn et al. | |
| 2004/0118401 | A1* | 6/2004 | Smith et al. | 128/204.17 |
| 2004/0129280 | A1 | 7/2004 | Woodson et al. | |
| 2004/0149296 | A1 | 8/2004 | Rostami et al. | |
| 2004/0200488 | A1 | 10/2004 | Felter et al. | |
| 2004/0226568 | A1 | 11/2004 | Takeuchi et al. | |
| 2004/0255965 | A1 | 12/2004 | Perfetti et al. | |
| 2004/0261790 | A1* | 12/2004 | Joshi et al. | 128/200.16 |
| 2005/0016549 | A1 | 1/2005 | Banerjee et al. | |
| 2005/0016550 | A1 | 1/2005 | Katase | |
| 2005/0066986 | A1 | 3/2005 | Nestor et al. | |
| 2005/0172976 | A1 | 8/2005 | Newman et al. | |
| 2005/0274390 | A1 | 12/2005 | Banerjee et al. | |
| 2006/0016453 | A1 | 1/2006 | Kim | |
| 2006/0070633 | A1 | 4/2006 | Rostami et al. | |
| 2006/0162733 | A1 | 7/2006 | McGrath et al. | |
| 2006/0185687 | A1 | 8/2006 | Hearn et al. | |
| 2006/0196518 | A1 | 9/2006 | Hon | |
| 2007/0074734 | A1 | 4/2007 | Braunshteyn et al. | |
| 2007/0102013 | A1 | 5/2007 | Adams et al. | |
| 2007/0215167 | A1 | 9/2007 | Crooks et al. | |
| 2007/0283972 | A1 | 12/2007 | Monsees et al. | |
| 2008/0085103 | A1* | 4/2008 | Beland et al. | 392/390 |
| 2008/0092912 | A1 | 4/2008 | Robinson et al. | |
| 2008/0149118 | A1 | 6/2008 | Oglesby et al. | |
| 2008/0245377 | A1 | 10/2008 | Marshall et al. | |
| 2008/0257367 | A1 | 10/2008 | Paterno et al. | |
| 2008/0276947 | A1 | 11/2008 | Martzel | |
| 2008/0302374 | A1 | 12/2008 | Wengert et al. | |
| 2009/0065010 | A1 | 3/2009 | Shands | |
| 2009/0095311 | A1 | 4/2009 | Han | |
| 2009/0095312 | A1 | 4/2009 | Herbrich et al. | |
| 2009/0126745 | A1 | 5/2009 | Hon | |
| 2009/0188490 | A1 | 7/2009 | Hon | |
| 2009/0230117 | A1 | 9/2009 | Fernando et al. | |
| 2009/0260641 | A1 | 10/2009 | Monsees et al. | |
| 2009/0260642 | A1 | 10/2009 | Monsees et al. | |
| 2009/0272379 | A1* | 11/2009 | Thorens et al. | 128/202.21 |
| 2009/0283103 | A1 | 11/2009 | Nielsen et al. | |
| 2009/0293892 | A1 | 12/2009 | Williams et al. | |
| 2009/0320863 | A1 | 12/2009 | Fernando et al. | |
| 2010/0006113 | A1 | 1/2010 | Urtsev et al. | |
| 2010/0024834 | A1 | 2/2010 | Oglesby et al. | |
| 2010/0043809 | A1 | 2/2010 | Magnon | |
| 2010/0059070 | A1 | 3/2010 | Potter et al. | |
| 2010/0059073 | A1 | 3/2010 | Hoffmann et al. | |
| 2010/0065075 | A1 | 3/2010 | Banerjee et al. | |
| 2010/0083959 | A1 | 4/2010 | Siller | |
| 2010/0163063 | A1 | 7/2010 | Fernando et al. | |
| 2010/0200006 | A1 | 8/2010 | Robinson et al. | |
| 2010/0229881 | A1 | 9/2010 | Hearn | |
| 2010/0242974 | A1 | 9/2010 | Pan | |
| 2010/0242976 | A1 | 9/2010 | Katayama et al. | |
| 2010/0258139 | A1 | 10/2010 | Onishi et al. | |
| 2010/0300467 | A1 | 12/2010 | Kuistila et al. | |
| 2010/0307518 | A1 | 12/2010 | Wang | |
| 2010/0313901 | A1 | 12/2010 | Fernando et al. | |
| 2011/0005535 | A1 | 1/2011 | Xiu | |
| 2011/0011396 | A1 | 1/2011 | Fang | |
| 2011/0036363 | A1 | 2/2011 | Urtsev et al. | |
| 2011/0036365 | A1 | 2/2011 | Chong et al. | |
| 2011/0073121 | A1 | 3/2011 | Levin et al. | |
| 2011/0088707 | A1 | 4/2011 | Hajaligol | |
| 2011/0094523 | A1 | 4/2011 | Thorens et al. | |
| 2011/0120482 | A1 | 5/2011 | Brenneise | |
| 2011/0126848 | A1 | 6/2011 | Zuber et al. | |
| 2011/0155153 | A1* | 6/2011 | Thorens et al. | 131/329 |
| 2011/0155718 | A1 | 6/2011 | Greim et al. | |
| 2011/0162663 | A1 | 7/2011 | Bryman | |
| 2011/0168194 | A1 | 7/2011 | Hon | |
| 2011/0180082 | A1 | 7/2011 | Banerjee et al. | |
| 2011/0265806 | A1* | 11/2011 | Alarcon et al. | 131/273 |
| 2011/0309157 | A1* | 12/2011 | Yang et al. | 239/6 |
| 2012/0042885 | A1 | 2/2012 | Stone et al. | |
| 2012/0060853 | A1 | 3/2012 | Robinson et al. | |
| 2012/0111347 | A1 | 5/2012 | Hon | |
| 2012/0231464 | A1 | 9/2012 | Yu et al. | |
| 2012/0279512 | A1 | 11/2012 | Hon | |
| 2012/0318882 | A1 | 12/2012 | Abehasera | |
| 2013/0081625 | A1* | 4/2013 | Rustad et al. | 128/204.17 |
| 2013/0081642 | A1 | 4/2013 | Safari | |
| 2013/0306084 | A1 | 11/2013 | Flick | |
| 2013/0319439 | A1* | 12/2013 | Gorelick et al. | 131/329 |
| 2013/0340775 | A1 | 12/2013 | Juster et al. | |

FOREIGN PATENT DOCUMENTS

| | | |
|---|---|---|
| CA | 2 752 255 | 8/2010 |
| CN | 1541577 | 11/2004 |
| CN | 2719043 | 8/2005 |
| CN | 200997909 | 1/2008 |
| CN | 101116542 | 2/2008 |
| CN | 101176805 | 5/2008 |
| CN | 201379072 | 1/2010 |
| DE | 10 2006 004 484 | 8/2007 |
| DE | 102006041042 | 3/2008 |
| DE | 20 2009 010 400 | 11/2009 |
| EP | 0 295 122 | 12/1988 |
| EP | 0 430 566 | 6/1991 |
| EP | 0 845 220 | 6/1998 |
| EP | 1618803 | 1/2006 |
| EP | 2 316 286 | 5/2011 |
| GB | 2469850 | 11/2010 |
| WO | WO 86/02528 | 5/1986 |
| WO | WO 97/48293 | 12/1997 |
| WO | WO 02/37990 | 5/2002 |

(56) References Cited

FOREIGN PATENT DOCUMENTS

| | | |
|---|---|---|
| WO | WO 2004/043175 | 5/2004 |
| WO | WO 2007/131449 | 11/2007 |
| WO | WO 2009/105919 | 9/2009 |
| WO | WO 2009/155734 | 12/2009 |
| WO | WO 2010/003480 | 1/2010 |
| WO | WO 2010/045670 | 4/2010 |
| WO | WO 2010/091593 | 8/2010 |
| WO | WO 2010/118644 | 10/2010 |
| WO | WO 2010/140937 | 12/2010 |
| WO | WO 2011/010334 | 1/2011 |
| WO | WO 2010/073122 | 7/2011 |
| WO | WO 2011/081558 | 7/2011 |

* cited by examiner

WICK SUITABLE FOR USE IN AN ELECTRONIC SMOKING ARTICLE

FIELD OF THE INVENTION

The present invention relates to aerosol delivery articles and uses thereof for yielding tobacco components or other materials in an inhalable form. The articles may be made or derived from tobacco or otherwise incorporate tobacco for human consumption.

BACKGROUND OF THE INVENTION

Many smoking articles have been proposed through the years as improvements upon, or alternatives to, smoking products based upon combusting tobacco. Exemplary alternatives have included devices wherein a solid or liquid fuel is combusted to transfer heat to tobacco or wherein a chemical reaction is used to provide such heat source. Numerous references have proposed various smoking articles of a type that generate flavored vapor, visible aerosol, or a mixture of flavored vapor and visible aerosol. Some of those proposed types of smoking articles include tubular sections or longitudinally extending air passageways.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco.

General examples of alternative smoking articles are described in U.S. Pat. No. 3,258,015 to Ellis et al.; U.S. Pat. No. 3,356,094 to Ellis et al.; U.S. Pat. No. 3,516,417 to Moses; U.S. Pat. No. 4,347,855 to Lanzellotti et al.; U.S. Pat. No. 4,340,072 to Bolt et al.; U.S. Pat. No. 4,391,285 to Burnett et al.; U.S. Pat. No. 4,917,121 to Riehl et al.; U.S. Pat. No. 4,924,886 to Litzinger; and U.S. Pat. No. 5,060,676 to Hearn et al. Many of those types of smoking articles have employed a combustible fuel source that is burned to provide an aerosol and/or to heat an aerosol-forming material. See, for example, the background art cited in U.S. Pat. No. 4,714,082 to Banerjee et al. and U.S. Pat. No. 4,771,795 to White et al.; which are incorporated herein by reference in their entireties. See, also, for example, those types of smoking articles described in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,551,451 to Riggs et al.; U.S. Pat. No. 5,595,577 to Bensalem et al.; U.S. Pat. No. 5,819,751 to Barnes et al.; U.S. Pat. No. 6,089,857 to Matsuura et al.; U.S. Pat. No. 6,095,152 to Beven et al; U.S. Pat. No. 6,578,584 Beven; and U.S. Pat. No. 6,730,832 to Dominguez; which are incorporated herein by reference in their entireties. Furthermore, certain types of cigarettes that employ carbonaceous fuel elements have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). See also US Pat. Pub. No. 2005/0274390 to Banerjee et al., US Pat. Pub. No. 2007/0215167 to Crooks et al., US Pat. Pub. No. 2010/0065075 to Banerjee et al., and US Pat. Pub. No. 2012/0042885 to Stone et al., the disclosures of which are incorporated herein by reference in their entireties.

Certain proposed cigarette-shaped tobacco products purportedly employ tobacco in a form that is not intended to be burned to any significant degree. See, for example, U.S. Pat. No. 4,836,225 to Sudoh; U.S. Pat. No. 4,972,855 to Kuriyama et al.; and U.S. Pat. No. 5,293,883 to Edwards, which are incorporated herein by reference in their entireties. Yet other types of smoking articles, such as those types of smoking articles that generate flavored vapors by subjecting tobacco or processed tobaccos to heat produced from chemical or electrical heat sources, are described in U.S. Pat. No. 4,848,374 to Chard et al.; U.S. Pat. Nos. 4,947,874 and 4,947,875 to Brooks et al.; U.S. Pat. No. 5,060,671 to Counts et al.; U.S. Pat. No. 5,146,934 to Deevi et al.; U.S. Pat. No. 5,224,498 to Deevi; U.S. Pat. No. 5,285,798 to Banerjee et al.; U.S. Pat. No. 5,357,984 to Farrier et al.; U.S. Pat. No. 5,593,792 to Farrier et al.; U.S. Pat. No. 5,369,723 to Counts; U.S. Pat. No. 5,692,525 to Counts et al.; U.S. Pat. No. 5,865,185 to Collins et al.; U.S. Pat. No. 5,878,752 to Adams et al.; U.S. Pat. No. 5,880,439 to Deevi et al.; U.S. Pat. No. 5,915,387 to Baggett et al.; U.S. Pat. No. 5,934,289 to Watkins et al.; U.S. Pat. No. 6,033,623 to Deevi et al.; U.S. Pat. No. 6,053,176 to Adams et al.; U.S. Pat. No. 6,164,287 to White; U.S. Pat. No. 6,289,898 to Fournier et al.; U.S. Pat. No. 6,615,840 to Fournier et al.; U.S. Pat. Pub. No. 2003/0131859 to Li et al.; U.S. Pat. Pub. No. 2005/0016549 to Banerjee et al.; and U.S. Pat. Pub. No. 2006/0185687 to Hearn et al., each of which is incorporated herein by reference in its entirety.

Certain attempts have been made to deliver vapors, sprays or aerosols, such as those possessing or incorporating flavors and/or nicotine. See, for example, the types of devices set forth in U.S. Pat. No. 4,190,046 to Virag; U.S. Pat. No. 4,284,089 to Ray; U.S. Pat. No. 4,635,651 to Jacobs; U.S. Pat. No. 4,735,217 to Gerth et al.; U.S. Pat. No. 4,800,903 to Ray et al.; U.S. Pat. No. 5,388,574 to Ingebrethsen et al.; U.S. Pat. No. 5,799,663 to Gross et al.; U.S. Pat. No. 6,532,965 to Abhulimen et al.; and U.S. Pat. No. 6,598,607 to Adiga et al; and EP 1,618,803 to Hon; which are incorporated herein by reference in their entireties. See also, U.S. Pat. No. 7,117,867 to Cox et al. and the devices set forth on the website, www.e-cig.com, which are incorporated herein by reference in their entireties.

Still further representative cigarettes or smoking articles that have been described and, in some instances, been made commercially available include those described in U.S. Pat. No. 4,922,901 to Brooks et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; US Pat. Pub. No. 2009/0095311 to Hon; US Pat. Pub. Nos. 2006/0196518, 2009/0126745, and 2009/0188490 to Hon; US Pat. Pub. No. 2009/0272379 to Thorens et al.; US Pat. Pub. Nos. 2009/0260641 and 2009/0260642 to Monsees et al.; US Pat. Pub. Nos. 2008/0149118 and 2010/0024834 to Oglesby et al.; US Pat. Pub. No. 2010/0307518 to Wang; and WO 2010/091593 to Hon. See also U.S. Pat. No. D657,047 to Minskoff et al. and US Pat. Pub. Nos. 2011/0277757, 2011/0277760, and US 2011/0277764 to Terry et al. Still further examples include electronic cigarette products commercially available under the names ACCORD®; HEATBAR™; HYBRID CIGARETTE®, VEGAS™; E-GAR™; C-GAR™; E-MYSTICK™; IOLITE® Vaporizer, GREEN SMOKE®, BLU™ Cigs, WHITE CLOUD® Cirrus, V2CIGS™, SOUTH BEACH SMOKE™, SMOKETIP®, SMOKE STIK®, NJOY®, LUCI®, Royal Blues, SMART SMOKER®, SMOKE ASSIST®, Knight Sticks, GAMUCCI®, InnoVapor, SMOKING EVERYWHERE®, Crown 7, CHOICE™ NO. 7™, VAPORKING®, EPUFFER®, LOGIC™ ecig, VAPOR4LIFE®, NICOTEK®, METRO®, VUSE®, and PREMIUM™.

Smoking articles that employ tobacco substitute materials and smoking articles that employ sources of heat other than burning tobacco cut filler to produce tobacco-flavored vapors or tobacco-flavored visible aerosols have not received widespread commercial success. Articles that produce the taste and sensation of smoking by electrically heating tobacco particularly have suffered from inconsistent release of flavors or other inhalable materials. Electrically heated smoking devices have further been limited in many instances to the requirement of an external heating device that was inconvenient and that detracted from the smoking experience. Accordingly, it can be desirable to provide a smoking article that can provide the sensations of cigarette, cigar, or pipe smoking, that does so without significantly combusting tobacco, that does so without the need of a combustion heat source, and that does so without necessarily delivering considerable quantities of incomplete combustion and pyrolysis products.

BRIEF SUMMARY OF THE INVENTION

The present invention provides a smoking article and methods of use thereof for controllably delivering aerosol precursor components. In particular, disclosed herein is an article that incorporates one or more wicks for use in vaporizing or aerosolizing a composition to provide a desired result to a consumer of the article. Such result can be to achieve an experience substantially similar to the smoking of a conventional cigarette or to achieve delivery of a flavor or the like.

In various embodiments, a smoking article according to the present disclosure can comprise a wick formed of a plurality of individual filaments aligned in a brush-like configuration. More particularly, the individual filaments of the wick each can comprise a first end that is affixed to a holding member and an opposing free end.

In addition to the wick, the smoking article can further include a hollow shell having the filaments of the wick positioned therein. For example, the hollow shell can be the outer shell of a cartridge. In certain embodiments, the filaments can be positioned within the hollow shell such that the free ends of the filaments are directed toward an interior of the hollow shell. More particularly, the filaments can be circumferentially positioned around a segment of an interior surface of the hollow shell (i.e., along portion of the length of the shell or along the entire length of the shell). The filaments can form substantially a single, uniform wick. In other embodiments, the filaments can form a plurality of separate wick in that the filaments can be characterized as being circumferentially positioned around a plurality of segments of the interior surface of the hollow shell. Thus, a series of separate wicks can be positioned along a length of the hollow shell, the filaments of the wicks having free ends that are directed toward an interior of the hollow shell. In addition to circumferential alignments, the filaments can be axially aligned along a length of the hollow shell. Such axial alignment can be substantially a straight line. Alternatively, the axial alignment can be substantially helical or any further alignment that does not substantially define a straight line. The filaments of the wicks can be randomly attached to the holding member or can be specifically patterned. In certain embodiments, the filaments can be aligned in a plurality of rows.

In further embodiments, the filaments of the wick can be positioned about a central axis of the hollow shell such that the free ends of the filaments are directed outward toward an outer wall of the hollow shell. In such embodiments, the smoking article further can comprise a central member extending along the central axis through at least a portion of the length of the hollow shell. The central member can be a reservoir and/or a holding member for the filaments. In certain embodiments, the filaments can be circumferentially positioned around a segment of the central member. Again, in some embodiments, the filaments can be circumferentially positioned around a plurality of segments of the central member. The width of the segment where the wick is present can vary, and wicks of different widths can be used in the same article. In still further embodiments, the filaments of the wick can be axially aligned along a length of the central member. Similar to the inwardly wicking wick, the axial alignment of the outwardly wicking wicks can vary. Specifically, the axial alignment can be substantially a straight line. Alternatively, the axial alignment can be substantially helical, and other non-straight alignments are also encompassed. In some embodiments, the filaments can be aligned in a plurality of rows. Although outwardly wicking wicks have been defined separately from the inwardly wicking wicks, it is understood that any combination of the various inwardly and outwardly wicking wicks can be used in a single smoking article.

The physical orientation of the filaments in the wicks can vary. In some embodiments, the filaments in a single wick can be substantially uniform in length. In other embodiments, the filaments of a single wick can be variable in length. When varying lengths are used, the filament lengths can define a specific pattern.

In addition to the wick, the hollow shell of the smoking article further can include an aerosol precursor composition. Preferably, the wick can be operatively positioned within the smoking article to be substantially in contact with the aerosol precursor composition (i.e., the filaments of the wicks being in fluid connection with the aerosol precursor composition). The aerosol precursor composition can be in the form of a liquid or gel at ambient conditions.

In some embodiments, the holding member to which the ends of the filaments are connected can be a reservoir, and the aerosol precursor composition can be retained by the reservoir. Thus, the filaments can be in direct contact with the reservoir. The reservoir and the wick can be present along only a segment of the hollow shell or can be present along the entire length of the hollow shell. If desired, a plurality of reservoirs can be used, and the reservoirs can be provided along a plurality of segments of the hollow shell, each segment having a defined width. Individual wicks then can be combined with the plurality of reservoirs. Alternatively, a single reservoir can be used, and a plurality of separate wicks can be present on a plurality of different segments of the reservoir.

In other embodiments, the holding member to which the ends of the filaments are connected can be distinct from the reservoir. In such embodiments, the smoking article thus can include an aerosol precursor composition retained by a reservoir and also can include a holding member to which the filaments are connected. Preferably, the holding member can be oriented relative to the reservoir such that the filaments of the wick are in fluid connection with the reservoir. In some embodiments, such can be achieved by embedding the holding member within the reservoir. More complex arrangements also are encompassed. For example, the holding member can be a hollow member, and the filaments can extend through an outer wall of the hollow holding member and into the hollow interior. The hollow holding member then can be connected to the reservoir, such as via appropriate tubing, such that liquid aerosol precursor composition from the reservoir can be transported to the hollow holding member to be transported by the filaments out of the hollow holding member. If desired active pumping of the liquid can be used, or one or more valves can be utilized to control flow of the liquid from the reservoir to the holding member.

The smoking article of the present disclosure further can include a heater. In specific embodiments, the heater can be a resistance heating wire. Such heating wire can be arranged with the filaments of the wick so as to provide for controlled heating of the aerosol precursor composition transported by the filaments. For example, the heating wire can be at least partially intertwined with the filaments of the wick. In some embodiments, the heating wire can actually be woven into the filaments of the wick. Machine weaving techniques can be used to weave the heating wire into the filaments. If desired, a single heating wire can be used and can be intertwined with the filaments randomly or in a defined pattern such that the desired heating of the filaments can be achieved. In other embodiments, the heater can comprise a plurality of resistance heating wires. Two or more heating wires thus can be intertwined with the filaments of a single wick. Alternatively, different heating wires can be intertwined with the filaments of the wick. For example, a first heater wire can be in contact with a first segment of the wick, and a second heater wire can be in contact with a second segment of the wick. Similarly, a first heater wire can be in contact with a first set of filaments, and a second heater wire can be in contact with a second set of filaments. Thus, the different heating wires can be used with a single wick or can be used with different wicks. This can be beneficial to provide for controlled aerosol composition and delivery. For example, a first set of filaments (e.g., a specific wick or a specific segment of a wick) can be adapted to transport a first aerosol precursor material and a second set of filaments (e.g., a specific wick or a specific segment of a wick) can be adapted to transport a second aerosol precursor material. This can be accomplished, for example, by segmenting a single reservoir such that different aerosol precursor materials are stored in separate segments of the reservoir or by providing a plurality of separate reservoirs in fluid connection with different sets of filaments or different wicks.

When utilizing a plurality of heating wires, the first heater wire and the second heater wire can provide differing heating modes. For example, a control component of the smoking article can be adapted to deliver electrical current to the wire in a manner such that the heating mode can be defined by one or more of heating temperature, heating rate, and total heating time.

From the above, it can be seen that the present disclosure provides a variety of wick designs that are adapted to achieve specific transport of an aerosol precursor composition. In some embodiments, a smoking article according to the disclosure can comprise a wick positioned within a hollow shell so as to transport an aerosol precursor material inward from an exterior wall of the hollow shell toward a central axis extending the length of the hollow shell. In other embodiments, a smoking article can comprise a wick positioned within a hollow shell so as to transport an aerosol precursor material outward from a central axis extending the length of the hollow shell toward an exterior wall of the hollow shell. The smoking article also can include a variety of further components such as an electrical power source and a control component, such as a puff-actuated sensor or a capacitive sensor.

In further embodiments, the present disclosure also encompasses methods of forming an aerosol in a smoking article. Specifically, the method can comprise initiating current flow from an electrical power source within the smoking article to a resistance heating wire within the smoking article, the heating wire being intertwined with a wick formed of a plurality of individual filaments aligned in a brush-like configuration so as to cause heating of the heating wire and an aerosol precursor composition transported by the wick. The smoking article can comprise a single heating wire of a plurality of heating wires. For example, two or more of the heating wires can be simultaneously heated to heat a single wick or a plurality of wicks. More specifically, the smoking article can be adapted to separately heat two or more separate components of the aerosol precursor composition utilizing two or more separate heating wires, which can be separately or simultaneously heated. When simultaneously heated, the heating wires can receive current flow from the electrical power source under different conditions such that the heating wires are heated to different temperatures or are heated for different amounts of time. Alternatively, two or more of the heating wires can be heated in a defined sequence or pattern.

BRIEF DESCRIPTION OF THE FIGURES

Figure 1:
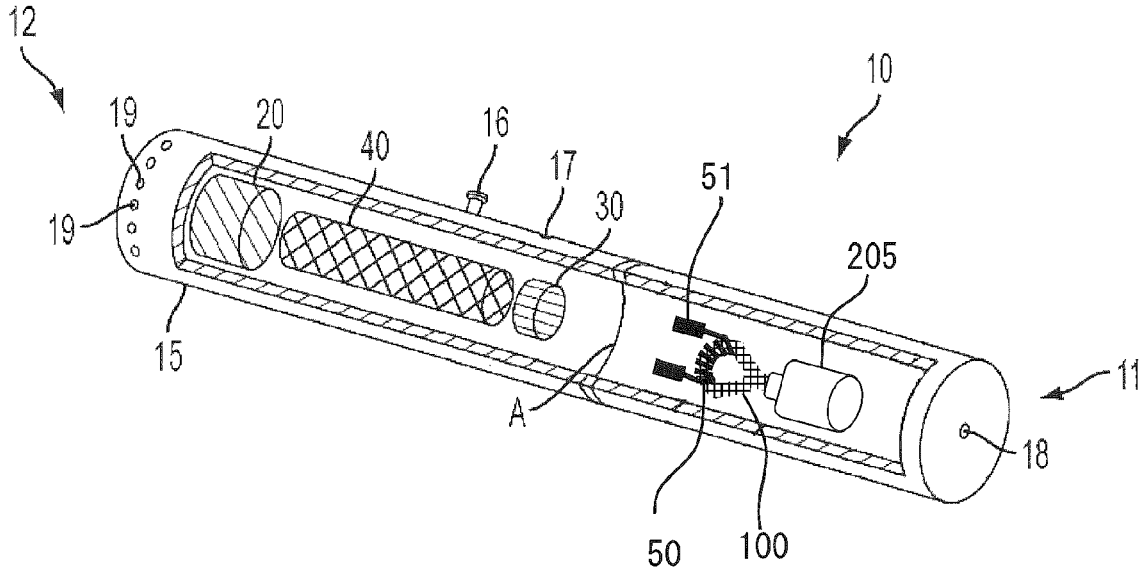
Figure 2:
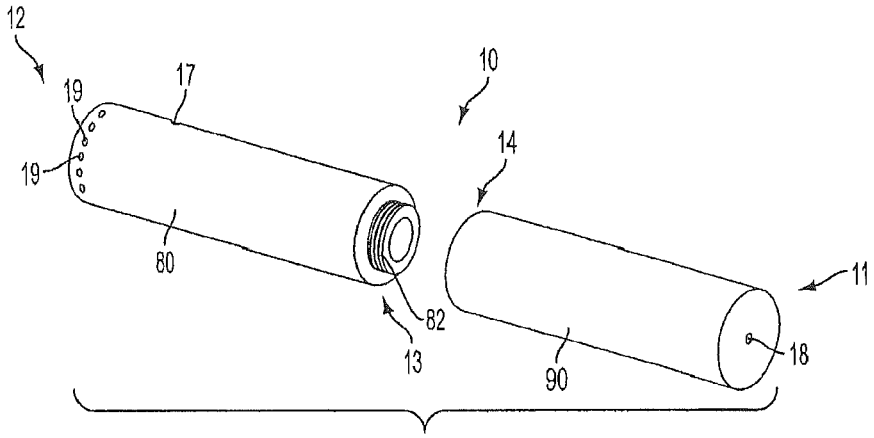
Figure 3:
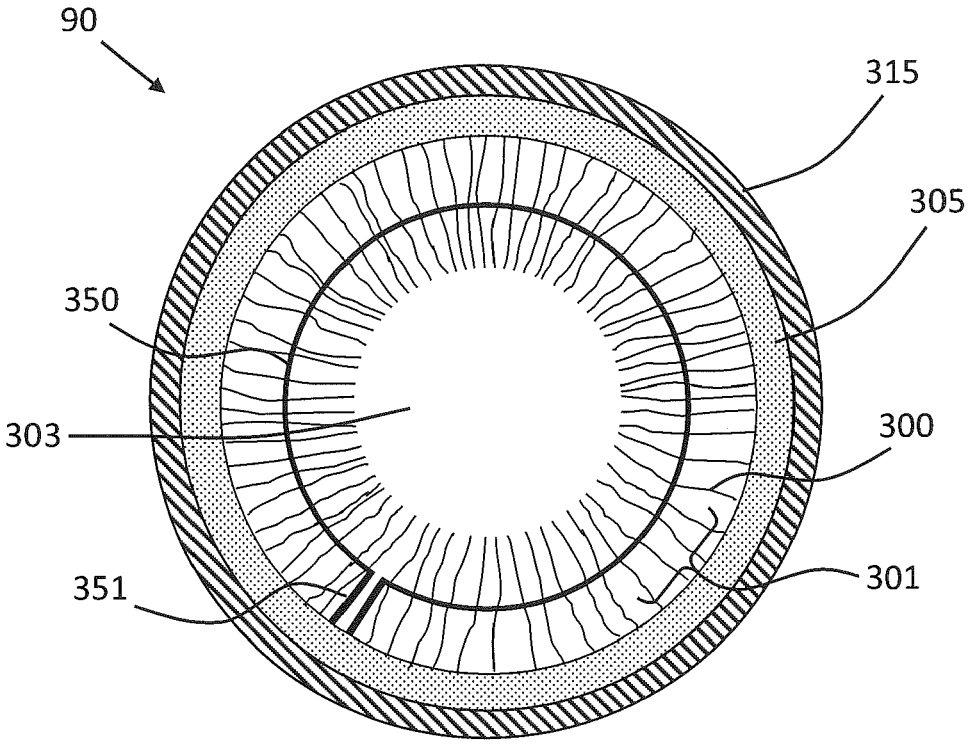
Figure 4:
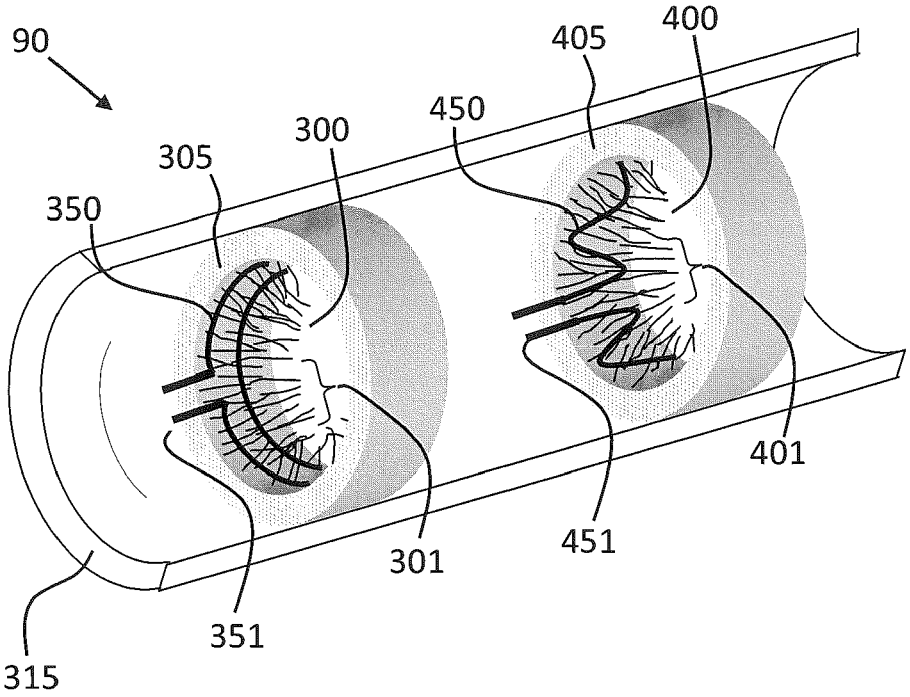
Figure 5:
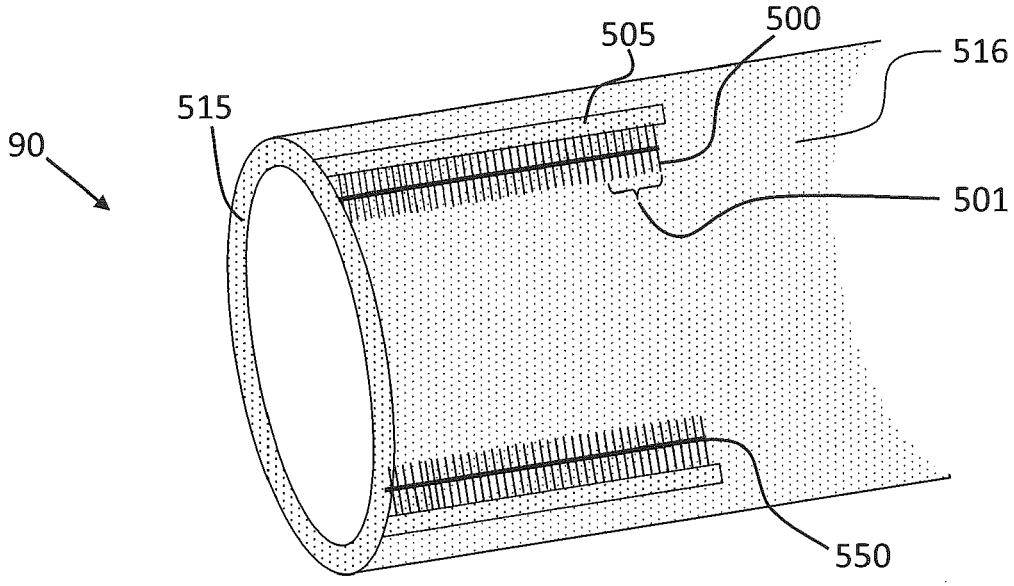
Figure 6:
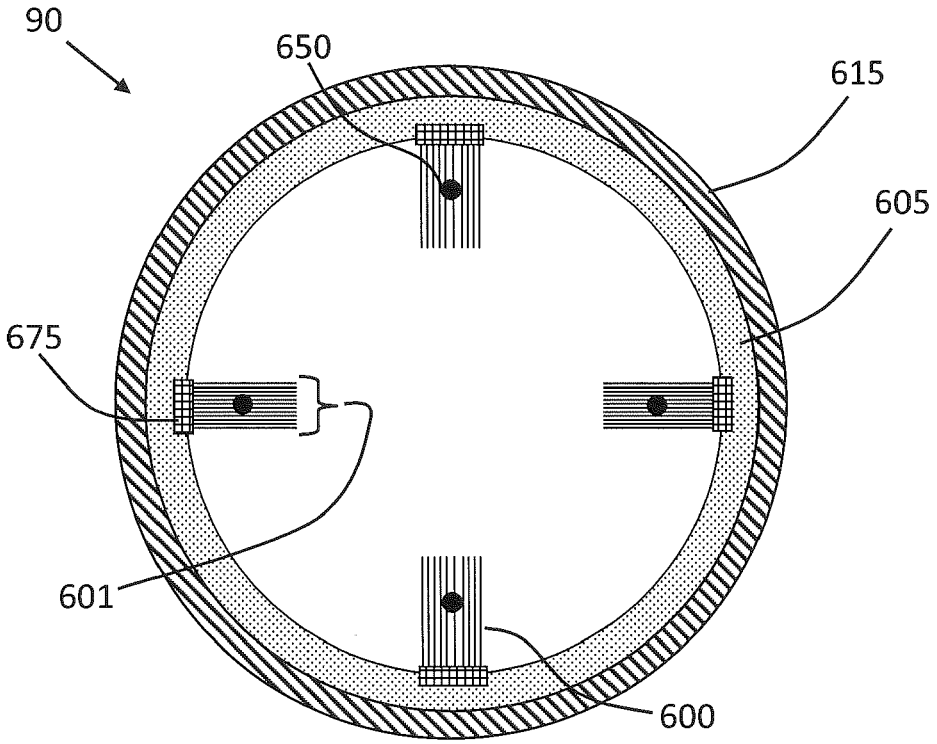
Figure 7:
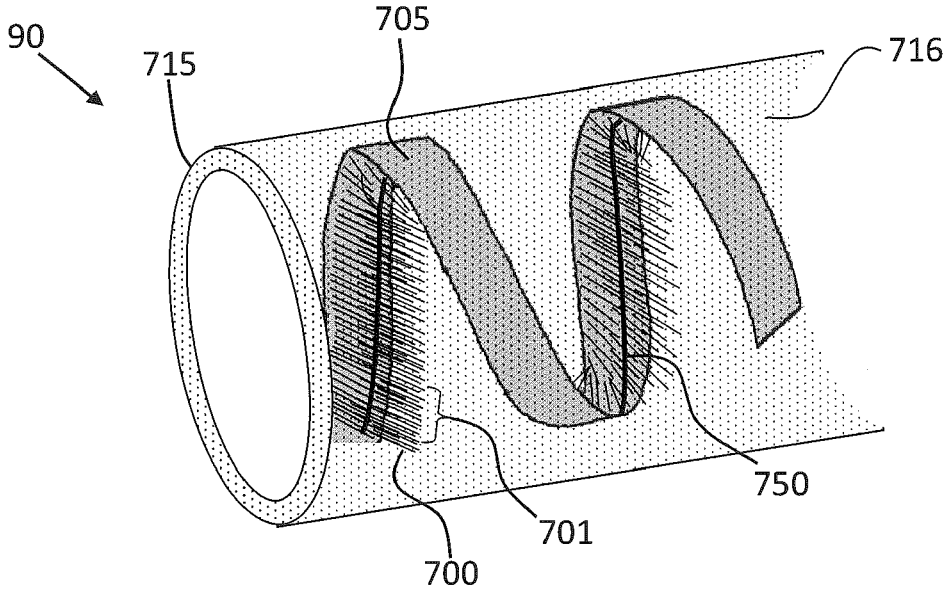
Figure 8:
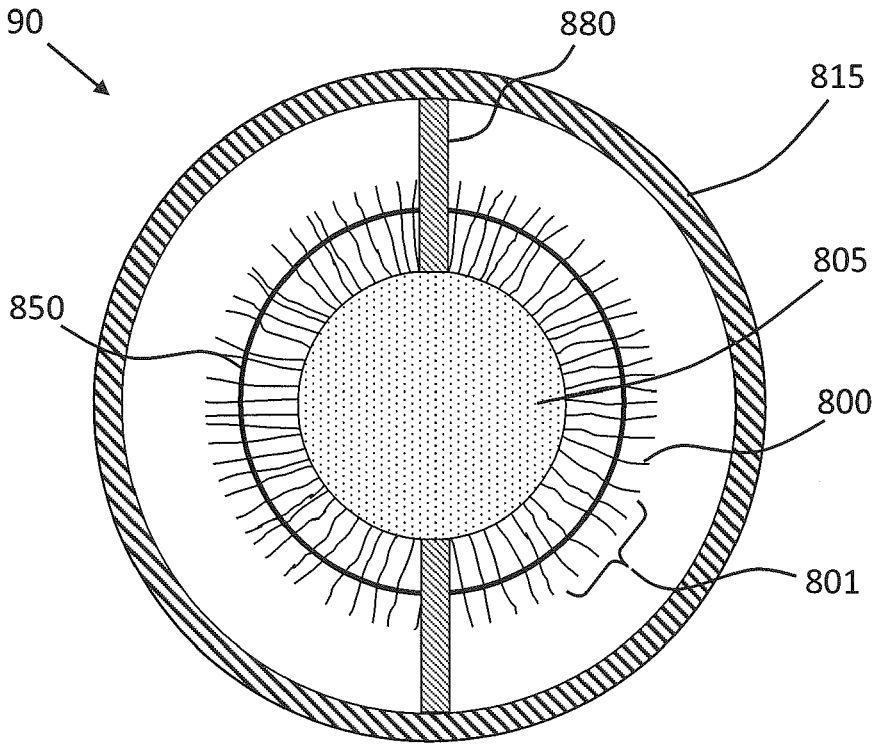
Figure 9:
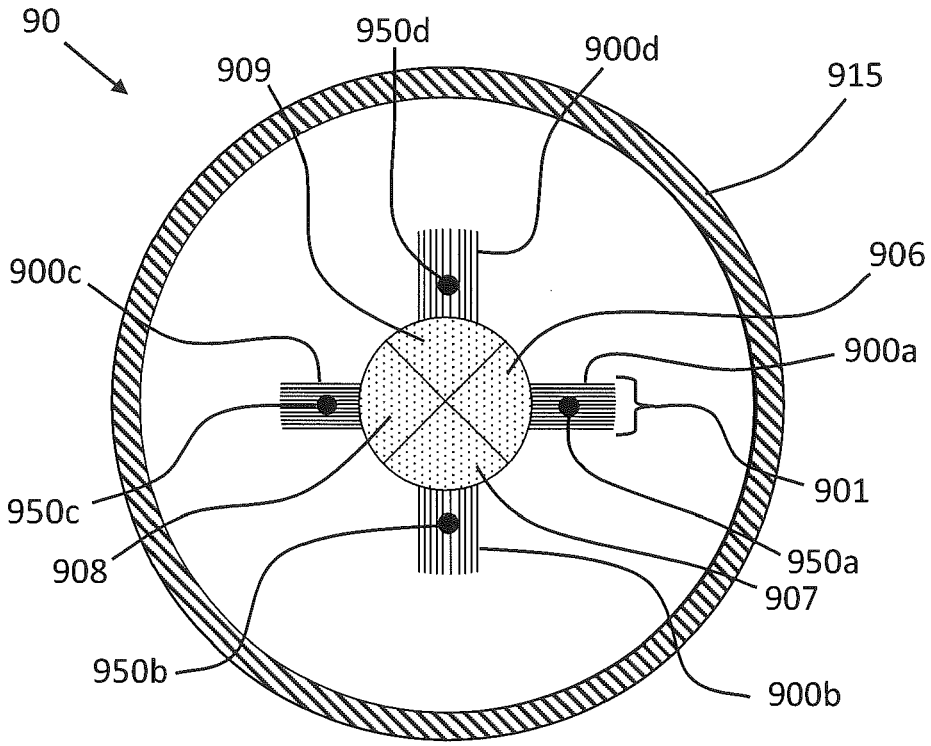
Figure 10:
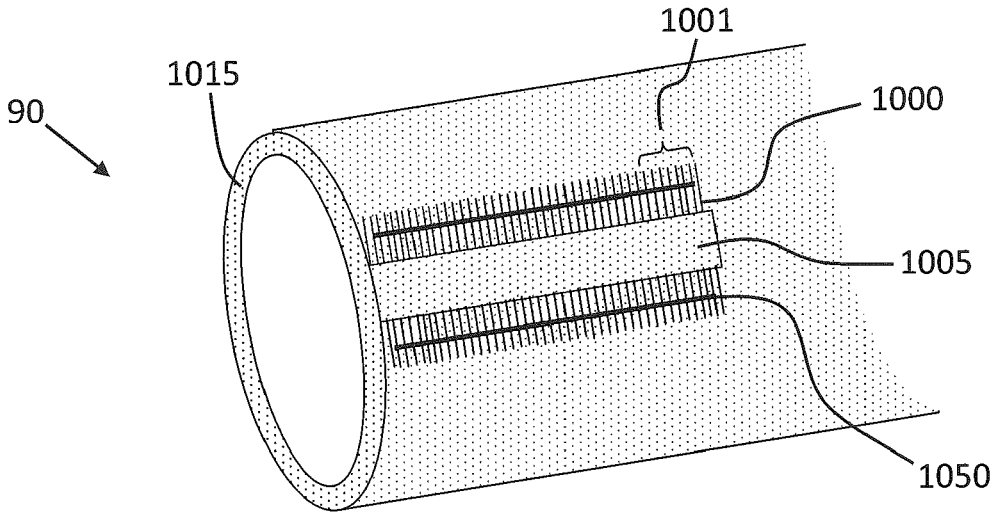

Having thus described the invention in the foregoing general terms, reference will now be made to the accompanying drawings, which are not necessarily drawn to scale, and wherein:

FIG. 1 is a perspective view of an example embodiment of a smoking article according to the disclosure, wherein a portion of an outer shell of the article is cut away to reveal the interior components thereof;

FIG. 2 is a perspective view of an example embodiment of a smoking article according to the disclosure, wherein the article comprises a control body and a cartridge that are attachable and detachable therefrom;

FIG. 3 is a cross-section of an example embodiment of a smoking article according to the disclosure showing a heating element in contact with a wick formed of a plurality of filaments circumferentially positioned around a segment of an interior surface of a hollow shell of a smoking article;

FIG. 4 is a perspective view of an example embodiment of a smoking article according to the disclosure showing a partially cut away shell revealing therein a plurality of reservoirs with circumferentially aligned filaments forming an inwardly wicking wick attached thereto;

FIG. 5 is a perspective view of an example embodiment of a smoking article according to the disclosure showing a hollow shell with a partially transparent outer wall and having therein a plurality of axially aligned wicks formed of a plurality of individual filaments in an inwardly wicking configuration, the wicks being in fluid communication with a reservoir;

FIG. 6 is a cross-section of an example embodiment of a smoking article according to the disclosure showing a reservoir around the interior circumference of a hollow shell, the reservoir having a plurality of wicks in fluid connection therewith, the wicks being formed of a plurality of individual filaments that are connected to a holding member at a first end and that have a second, free end aligned in an inwardly wicking configuration;

FIG. 7 is a perspective view of an example embodiment of a smoking article according to the disclosure showing a hollow shell with a partially transparent outer wall, the hollow shell having therein a helical, axially aligned reservoir having a plurality of individual filaments in a fluid connection therewith forming an inwardly wicking wick;

FIG. 8 is a cross-section of an example embodiment of a smoking article according to the disclosure showing a central member within a hollow shell, the central member functioning as a reservoir and having a plurality of wicks in fluid connection therewith, the wicks being formed of a plurality of individual filaments that are connected to the holding member and that are aligned in an outwardly wicking configuration;

FIG. 9 is a cross-section of an example embodiment of a smoking article according to the disclosure showing a central member within a hollow shell, the central member functioning as a reservoir and having a plurality of wicks in fluid connection therewith, the wicks being formed of a plurality of individual filaments that are connected to the central member at a first end and that have a second, free end aligned in an outwardly wicking configuration; and FIG. 10 is a perspective view of an example embodiment of a smoking article according to the disclosure showing a hollow shell with a partially transparent outer wall and having therein a plurality of axially aligned wicks formed of a plurality of individual filaments in an outwardly wicking configuration, the wicks being in fluid connection with a central member functioning as a reservoir.

DETAILED DESCRIPTION OF THE INVENTION

The present invention will now be described more fully hereinafter with reference to exemplary embodiments thereof. These exemplary embodiments are described so that this disclosure will be thorough and complete, and will fully convey the scope of the invention to those skilled in the art. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present invention provides articles that use electrical energy to heat a material (preferably without combusting the material to any significant degree) to form an inhalable substance, the articles being sufficiently compact to be considered "hand-held" devices. In certain embodiments, the articles can particularly be characterized as smoking articles. As used herein, the term is intended to mean an article that provides the taste and/or the sensation (e.g., hand-feel or mouth-feel) of smoking a cigarette, cigar, or pipe without substantial combustion of any component of the article. The term smoking article does not necessarily indicate that, in operation, the article produces smoke in the sense of the by-product of combustion or pyrolysis. Rather, smoking relates to the physical action of an individual in using the article—e.g., holding the article, drawing on one end of the article, and inhaling from the article. In further embodiments, the inventive articles can be characterized as being vapor-producing articles, aerosolization articles, or medicament delivery articles. Thus, the articles can be arranged so as to provide one or more substances in an inhalable state. In other embodiments, the inhalable substance can be substantially in the form of a vapor (i.e., a substance that is in the gas phase at a temperature lower than its critical point). In other embodiments, the inhalable substance can be in the form of an aerosol (i.e., a suspension of fine solid particles or liquid droplets in a gas). The physical form of the inhalable substance is not necessarily limited by the nature of the inventive articles but rather may depend upon the nature of the medium and the inhalable substance itself as to whether it exists in a vapor state or an aerosol state. In some embodiments, the terms may be interchangeable. Thus, for simplicity, the terms as used to describe the invention are understood to be interchangeable unless stated otherwise.

In one aspect, the present invention provides a smoking article. The smoking article generally can include a number of components provided within an elongated body, which can be a single, unitary shell or which can be formed of two or more separable pieces. For example, a smoking article according to one embodiment can comprise a shell (i.e., the elongated body) that can be substantially tubular in shape, such as resembling the shape of a conventional cigarette or cigar. Within the shell can reside all of the components of the smoking article (one or more of which may be replaceable). In other embodiments, a smoking article can comprise two shells that are joined and are separable. For example, a control body can comprise a shell containing one or more reusable components and having an end that removably attaches to a cartridge. The cartridge can comprise a shell containing one or more disposable components and having an end that removably attaches to the control body. More specific arrangements of components within the single shell or within the separable control body and cartridge are evident in light of the further disclosure provided herein.

Smoking articles useful according to the invention particularly can comprise some combination of a power source (i.e., an electrical power source), one or more control components (e.g., to control/actuate/regulate flow of power from the power source to one or more further components of the article), a heater component, and an aerosol precursor composition. The smoking article further can include a defined air flow path through the article such that aerosol generated by the article can be withdrawn therefrom by a user drawing on the article. Alignment of the components within the article can vary. In specific embodiments, the aerosol precursor composition can be located near an end of the article that is proximal to the mouth of a user so as to maximize aerosol delivery to the user. Other configurations, however, are not excluded. Generally, the heater component can be positioned sufficiently near the aerosol precursor composition so that heat from the heater component can volatilize the aerosol precursor material (as well as one or more flavorants, medicaments, or the like that may likewise be provided for delivery to a user) and form an aerosol for delivery to the user. When the heating member heats the aerosol precursor composition, an aerosol (comprising one or more components of the aerosol precursor composition) is formed, released, or generated in a physical form suitable for inhalation by a consumer. It should be noted that the foregoing terms are meant to be interchangeable. As such, the terms release, generate, and form can be interchangeable, the terms releasing, generating, and forming can be interchangeable, the terms releases, forms, and generates can be interchangeable, and the terms released, formed, and generated can be interchangeable. Specifically, one or more components of the aerosol precursor composition is vaporized and mixed with air to form an aerosol for inhalation by a user.

Referring now to FIG. 1, a smoking article 10 according to the invention generally can comprise a shell 15 and a plurality of components provided within the shell. The article can be characterized as having a mouth end 11 (i.e., the end upon which a consumer can draw to inhale aerosol from the article), and a distal end 12. The illustrated article is provided as a single unitary device (however, line A indicates an optional demarcation whereby the device can be two separate components that are joined together, either removably or permanently, such as by gluing). As will be evident from the further disclosure herein, it can be preferable for further embodiments of the article to be formed of two or more detachable units, each housing separate components of the article. The various components shown in the embodiment of FIG. 1 can be present in other embodiments, including embodiments formed of multiple units.

The article 10 according to the invention can have an overall shape that may be defined as being substantially rod-like or substantially tubular shaped or substantially cylindrically shaped. As illustrated in FIG. 1, the article has a substantially round cross-section; however, other cross-sectional shapes (e.g., oval, square, triangle, etc.) also are encompassed by the present disclosure. Such language that is descriptive of the physical shape of the article may also be applied to the individual units of the article in embodiments comprising multiple units, such as a control body and a cartridge.

The shell 15 of the smoking article 10 can be formed of any material suitable for forming and maintaining an appropriate conformation, such as a tubular shape, and for retaining therein the suitable components of the article. The shell can be formed of a single wall, as shown in FIG. 1. In some embodiments, the shell can be formed of a material (natural or synthetic) that is heat resistant so as to retain its structural integrity—e.g., does not degrade—at least at a temperature that is the heating temperature provided by the resistive heating element, as further discussed herein. In some embodiments, a heat resistant polymer or a metal (e.g., stainless steel) may be used. In other embodiments, the shell can be formed from paper, such as a paper that is substantially straw-shaped. As further discussed herein, the shell, such as a paper tube, may have one or more layers associated therewith that function to substantially prevent movement of heat or vapor therethrough. In one example, an aluminum foil layer may be laminated to one surface of the shell. Ceramic materials also may be used.

As seen in the embodiment of FIG. 1, the smoking article 10 can include an electronic control component 20, a flow sensor 30, and a battery 40, and these components can be placed in a variety of orders within the article. Although not expressly shown, it is understood that the article 10 can include wiring as necessary to provide power from the battery 40 to the further components and to interconnect the components for appropriate operation of the necessary functions provided by the article.

The battery 40 is one example of an electrical power source (or electrical power sources) that can be present to provide current flow that is sufficient to provide various functionalities to the article, such as powering of the heater elements, powering of indicators, powering of internal circuitry, and the like. The power source can take on various embodiments. Preferably, the power source is able to deliver sufficient power to rapidly heat a resistive heater to provide for aerosol formation and power the article through use for the desired duration of time. The power source preferably is sized to fit conveniently within the article. Examples of useful power sources include lithium ion batteries that preferably are rechargeable (e.g., a rechargeable lithium-manganese dioxide battery). In particular, lithium polymer batteries can be used. Other types of batteries—e.g., N50-AAA CADNICA nickel-cadmium cells—may also be used. Even further examples of batteries that can be used according to the invention are described in US Pub. App. No. 2010/0028766, the disclosure of which is incorporated herein by reference in its entirety. Thin film batteries may be used in certain embodiments of the invention. Any of these batteries or combinations thereof can be used in the power source, but rechargeable batteries are preferred because of cost and disposal considerations associated with disposable batteries. In embodiments wherein disposable batteries are provided, the smoking article can include access for removal and replacement of the battery. Alternatively, in embodiments where rechargeable batteries are used, the smoking article can comprise charging contacts for interaction with corresponding contacts in a conventional recharging unit deriving power from a standard 120-volt AC wall outlet, or other sources such as an automobile electrical system or a separate portable power supply, including USB connections. Means for recharging the battery can be provided in a portable charging case that can include, for example, a relatively larger battery unit that can provide multiple charges for the relatively smaller batteries present in the smoking article. The article further can include components for providing a non-contact inductive recharging system such that the article can be charged without being physically connected to an external power source. Thus, the article can include components to facilitate transfer of energy from an electromagnetic field to the rechargeable battery within the article.

In further embodiments, the power source also can comprise a capacitor. Capacitors are capable of discharging more quickly than batteries and can be charged between puffs, allowing the battery to discharge into the capacitor at a lower rate than if it were used to power the heating member directly. For example, a supercapacitor—i.e., an electric double-layer capacitor (EDLC)—may be used separate from or in combination with a battery. When used alone, the supercapacitor may be recharged before each use of the article. Thus, the invention also may include a charger component that can be attached to the smoking article between uses to replenish the supercapacitor.

The smoking article can further include a variety of power management software, hardware, and/or other electronic control components. For example, such software, hardware, and/or electronic controls can include carrying out charging of the battery, detecting the battery charge and discharge status, performing power save operations, preventing unintentional or over-discharge of the battery, puff counting, puff delimiting, puff duration, identifying cartridge status, temperature control, or the like. As such, the articles of the disclosure can include one or more microchips or microcontrollers. Moreover, the articles can be adapted for inclusion of programmable hardware that can be pre-programmed and/or can be programmed post-market, such as via input of software or other commands that can be downloaded by the hardware through an included linking port (e.g., a USB port or similar port that can allow for attachment of the article to a computer, smart phone, tablet, or the like), or through a wireless communication component.

The control component 20 can encompass a variety of elements useful in the present smoking article. Moreover, a smoking article according to the invention can include one, two, or even more control components that can be combined into a unitary element or that can be present at separate locations within the smoking article, and individual control components can be utilized for carrying out different control aspects. For example, a smoking article can include a control component that is integral to or otherwise combined with a battery so as to control power discharge from the battery. The smoking article separately can include a control component that controls other aspects of the article. The smoking article also can include a control component in a cartridge for providing specific functionalities, including data storage (e.g., a microchip that includes memory). Such control component can include any hardware and/or software elements as otherwise discussed herein.

Alternatively, a single controller may be provided that carries out multiple control aspects or all control aspects of the article. Likewise, a sensor 30 (e.g., a puff sensor) used in the article can include a control component that controls the actuation of power discharge from the power source in response to a stimulus. If desired, multiple controllers and/or sensors can be used. The article separately can include a control component that controls other aspects of the article. Specifically, a single controller may be provided in or otherwise associated with the sensor for carrying out multiple control aspects or all control aspects of the article. Thus, a variety of combinations of controllers may be combined in the present smoking article to provide the desired level of control of all aspects of the device.

The smoking article also can comprise one or more controller components useful for controlling flow of electrical energy from the power source to further components of the article, such as to a resistive heating element. Specifically, the article can comprise a control component that actuates current flow from the power source, such as to the resistive heating element. For example, in some embodiments, the article can include a pushbutton that can be linked to a control circuit for manual control of power flow. One or more pushbuttons present can be substantially flush with an outer surface of the smoking article.

Instead of (or in addition to) the pushbutton, the inventive article can include one or more control components or sensors responsive to the consumer's drawing on the article (i.e., puff-actuated heating). For example, the article may include a switch that is sensitive either to pressure changes or air flow changes as the consumer draws on the article (i.e., a puff-actuated switch). Other current actuation/deactuation mechanisms may include a temperature actuated on/off switch or a lip pressure actuated switch. An exemplary mechanism that can provide such puff-actuation capability includes a Model 163PC01D36 silicon sensor, manufactured by the MicroSwitch division of Honeywell, Inc., Freeport, Ill. Further examples of demand-operated electrical switches that may be employed in a heating circuit according to the present invention are described in U.S. Pat. No. 4,735,217 to Gerth et al., which is incorporated herein by reference in its entirety. Other suitable differential switches, analog pressure sensors, flow rate sensors, or the like, will be apparent to the skilled artisan with the knowledge of the present disclosure. A pressure-sensing tube or other passage providing fluid connection between the puff actuated switch and an air flow passage within the smoking article can be included so that pressure changes during draw are identified by the switch. Further description of current regulating circuits and other control components, including microcontrollers, that can be useful in the present smoking article are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., and U.S. Pat. No. 7,040,314 to Nguyen et al., all of which are incorporated herein by reference in their entireties.

Capacitive sensing components in particular can be incorporated into the device in a variety of manners to allow for diverse types of "power-up" and/or "power-down" for one or more components of the device. Capacitive sensing can include the use of any sensor incorporating technology based on capacitive coupling including, but not limited to, sensors that detect and/or measure proximity, position or displacement, humidity, fluid level, pressure, temperature, or acceleration. Capacitive sensing can arise from electronic components providing for surface capacitance, projected capacitance, mutual capacitance, or self capacitance. Capacitive sensors generally can detect anything that is conductive or has a dielectric different than that of air. Capacitive sensors, for example, can replace mechanical buttons (i.e., the pushbutton referenced above) with capacitive alternatives. Thus, one specific application of capacitive sensing according to the invention is a touch capacitive sensor. For example, a touch pad can be present on the smoking article that allows the user to input a variety of commands. Most basically, the touch pad can provide for powering the heating element much in the same manner as a push button, as already described above. In other embodiments, capacitive sensing can be applied near the mouth end of the smoking article such that the pressure of the lips on the smoking article to draw on the article can signal the device to provide power to the heating element. In addition to touch capacitance sensors, motion capacitance sensors, liquid capacitance sensors, and accelerometers can be utilized according to the invention to elicit a variety of response from the smoking article. Further, photoelectric sensors also can be incorporated into the inventive smoking article.

Sensors utilized in the present articles can expressly signal for power flow to the heating element so as to heat the aerosol precursor composition and form a vapor or aerosol for inhalation by a user. Sensors also can provide further functions. For example, a "wake-up" sensor can be included. Other sensing methods providing similar function likewise can be utilized according to the invention.

Returning to FIG. 1, the article 10 can include a resistive heating element 50. The resistive heating element can be electrically connected to the battery 40 through appropriate wiring to facilitate formation of a closed electrical circuit with current flowing through the resistive heating element. Further wiring (not illustrated) can be included to provide the necessary electrical connections within the article. In specific embodiments, the article 10 can be wired with an electrical circuit such that the control component 20 delivers, controls, or otherwise modulates power from the battery 40 for energizing the resistive heating element 50 according to one or more defined algorithms, including pulse width modulation. Such electrical circuit can specifically incorporate the flow sensor 30 such that the article 10 is only active at times of use by the consumer. For example, when a consumer puffs on the article 10, the flow sensor detects the puff, and the control component 20 is then activated to direct power through the article such that the resistive heating element 50 produces heat and thus provides aerosol for inhalation by the consumer. The control algorithm may call for power to the resistive heating element 50 to cycle and thus maintain a defined temperature. The control algorithm therefore can be programmed to automatically deactivate the article 10 and discontinue power flow through the article after a defined time lapse without a puff by a consumer. Moreover, the article can include a temperature sensor to provide feedback to the control component. Such sensor can be, for example, in direct contact with the resistive heating element 50. Alternative temperature sensing means likewise can be used, such as relying upon logic control components to evaluate resistance through the resistive heating element and correlate such resistance to the temperature of the element. In other embodiments, the flow sensor 30 can be replaced by appropriate components to provide alternative sensing means, such as capacitive sensing. Any variety of sensors and combinations thereof can be incorporated, as described herein. Still further, one or more control buttons 16 can be included to allow for manual actuation by a consumer to elicit a variety of functions, such as powering the article 10 on and off, turning on the resistive heating element 50 to generate a vapor or aerosol for inhalation, or the like.

When the consumer draws on the mouth end of the smoking article, the current actuation means can permit unrestricted or uninterrupted flow of current through the resistive heating member to generate heat rapidly. It can be useful to include current regulating components to regulate current flow through the heater element to control heating rate and/or heating duration.

The current regulating circuit particularly may be time based. Specifically, such a circuit includes a means for permitting uninterrupted current flow through the heating element for an initial time period during draw, and a timer means for subsequently regulating current flow until draw is completed. Further, regulation may comprise simply allowing uninterrupted current flow until the desired temperature is achieved then turning off the current flow completely. The heating member may be reactivated by the consumer initiating another puff on the article (or manually actuating the pushbutton, depending upon the specific switch embodiment employed for activating the heater). Alternatively, the subsequent regulation can involve the modulation of current flow through the heating element to maintain the heating element within a desired temperature range (including pulse width modulation). In some embodiments, so as to release the desired dosing of the inhalable substance, the heating member may be energized for a duration of about 0.2 second to about 5.0 seconds, about 0.3 second to about 4.5 seconds, about 0.5 second to about 4.0 seconds, about 0.5 second to about 3.5 seconds, or about 0.6 second to about 3.0 seconds. Further description of such time-based current regulating circuits and other control components that can be useful in the present smoking article are provided in U.S. Pat. Nos. 4,922,901, 4,947,874, and 4,947,875, all to Brooks et al., all of which are incorporated herein by reference in their entireties.

The control components particularly can be configured to closely control the amount of heat provided to the heater. In some embodiments, the current regulating component can function to stop current flow to the heater once a defined temperature has been achieved. Such defined temperature can be in a range that is substantially high enough to volatilize the aerosol precursor composition and any further inhalable substances and provide an amount of aerosol in a desired concentration. While the heat needed to volatilize the aerosol precursor composition can vary, it can be particularly useful for the heater to heat to a temperature of about 120° C. or greater, about 130° C. or greater, about 140° C. or greater, or about 160° C. or greater. In some embodiments, in order to volatilize a desired amount of the aerosol precursor composition, the heating temperature may be about 180° C. or greater, about 200° C. or greater, about 300° C. or greater, or about 350° C. or greater. In further embodiments, the defined temperature for aerosol formation can be about 120° C. to about 350° C., about 140° C. to about 300° C., or about 150° C. to about 250° C. The temperature and time of heating can be controlled by one or more components contained in the control housing. The current regulating component likewise can cycle the current to the heater off and on once a defined temperature has been achieved so as to maintain the defined temperature for a defined period of time.

Still further, the current regulating component can cycle the current to the heater off and on to maintain a first temperature that is below an aerosol forming temperature and then allow an increased current flow in response to a current actuation control component so as to achieve a second temperature that is greater than the first temperature and that is an aerosol forming temperature. Such controlling can improve the response time of the article for aerosol formation such that aerosol formation begins almost instantaneously upon initiation of a puff by a consumer. In some embodiments, the first temperature (which can be characterized as a standby temperature) can be only slightly less than the aerosol forming temperature defined above. Specifically, the standby temperature can be about 50° C. to about 150° C., about 70° C. to about 140° C., about 80° C. to about 120° C., or about 90° C. to about 110° C.

The resistive heating element can be formed of a material that provides resistive heating when an electrical current is applied thereto. Preferably, the resistive heating element exhibits an electrical resistance making the resistive heating element useful for providing a sufficient quantity of heat when electrical current flows therethrough. In some embodiments, a flow rate heating algorithm can be applied whereby heat output from the heating element is proportional to the flow rate of air through the device.

Electrically conductive materials useful as resistive heating elements can be those having low mass, low density, and moderate resistivity and that are thermally stable at the temperatures experienced during use. Useful heating elements heat up and cool down rapidly, and thus provide for the efficient use of energy. Rapid heating of the element can be beneficial to provide almost immediate volatilization of an aerosol precursor material in proximity thereto. Rapid cooling prevents substantial volatilization (and hence waste) of the aerosol precursor material during periods when aerosol formation is not desired. Such heating elements also permit relatively precise control of the temperature range experienced by the aerosol precursor material, especially when time based current control is employed. Useful electrically conductive materials preferably are chemically non-reactive with the materials being heated (e.g., aerosol precursor materials and other inhalable substance materials) so as not to adversely affect the flavor or content of the aerosol or vapor that is produced. Exemplary, non-limiting, materials that can be used as the electrically conductive material include carbon, graphite, carbon/graphite composites, metals, metallic and non-metallic carbides, nitrides, silicides, inter-metallic compounds, cermets, metal alloys, metal oxides, and metal foils. In particular, refractory materials may be useful. Various, different materials can be mixed to achieve the desired properties of resistivity, mass, and thermal conductivity. In specific embodiments, metals that can be utilized include, for example, nickel, chromium, alloys of nickel and chromium (e.g., nichrome), and steel. Materials that can be useful for providing resistive heating are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

The resistive heating element can be provided in a variety forms, such as in the form of a foil, a foam, discs, spirals, fibers, wires, films, yarns, strips, ribbons, or cylinders, as well as irregular shapes of varying dimensions. In some embodiments, a resistive heating element according to the present disclosure can be a conductive substrate, such as described in co-pending U.S. patent application Ser. No. 13/432,406, filed Mar. 28, 2012, the disclosure of which is incorporated herein by reference in its entirety. The resistive heating element also may be present as part of a microheater component, such as described in co-pending U.S. patent application Ser. No. 13/602,871, filed Sep. 4, 2012, the disclosure of which is incorporated herein by reference in its entirety.

The resistive heating element preferably is in electrical connection with the power source of the smoking article such that electrical energy can be provided to the resistive heating element to produce heat and subsequently aerosolize the aerosol precursor composition and its various components. Such electrical connection can be permanent (e.g., hard wired) or can be removable (e.g., wherein the resistive heating element is provided in a cartridge that can be attached to and detached from a control body that includes the power source).

Beneficially, the resistive heating element can be provided in a form that enables the heating element to be positioned in intimate contact with or in close proximity to the aerosol precursor material. In other embodiments, the resistive heating element can be provided in a form such that the aerosol precursor material can be delivered to the resistive heating element for aerosolization. For example, the aerosol precursor composition (or components thereof) can be provided in liquid form so as to allow the composition to flow from one or more reservoirs to the resistive heating element, such as via capillary action through a wick or other porous material. As such, the aerosol precursor composition may be provided in liquid form in one or more reservoirs positioned sufficiently away from the resistive heating element to prevent premature aerosolization, but positioned sufficiently close to the resistive heating element to facilitate transport of the aerosol precursor composition, in the desired amount, to the resistive heating element for aerosolization.

The amount of aerosol released by the inventive article can vary. Preferably, the article is configured with a sufficient amount of the aerosol precursor composition, with a sufficient amount of any further inhalable substance, and to function at a sufficient temperature for a sufficient time to release a desired content of aerosolized materials over a course of use. The content may be provided in a single inhalation from the article or may be divided so as to be provided through a number of puffs from the article over a relatively short length of time (e.g., less than 30 minutes, less than 20 minutes, less than 15 minutes, less than 10 minutes, or less than 5 minutes). For example, the article may provide nicotine in an amount of about 0.01 mg to about 0.5 mg, about 0.05 mg to about 0.3 mg, or about 0.1 mg to about 0.2 mg per puff on the article. For purposes of calculations, an average puff time of about 2 seconds can deliver a puff volume of about 5 ml to about 100 ml, about 15 ml to about 70 ml, about 20 ml to about 60 ml, or about 25 ml to about 50 ml. A smoking article according to the invention can be configured to provide any number of puffs calculable by the total amount of aerosol or other inhalable substance to be delivered divided by the amount to be delivered per puff. The one or more reservoirs can be loaded with the appropriate amount of aerosol precursor or other inhalable substance to achieve the desired number of puffs and/or the desired total amount of material to be delivered.

In further embodiments, heating can be characterized in relation to the amount of aerosol to be generated. Specifically, the article can be configured to provide an amount of heat necessary to generate a defined volume of aerosol (e.g., about 5 ml to about 100 ml, or any other volume deemed useful in a smoking article, such as otherwise described herein). In certain embodiments, the amount of heat generated can be measured in relation to a two to four second puff providing about 35 ml of aerosol at a heater temperature of about 290° C. In some embodiments, the article preferably can provide about 1 to about 50 Joules of heat per second (J/s), about 2 J/s to about 40 J/s, about 3 J/s to about 35 J/s, or about 5 J/s to about 30 J/s.

The article can include one or more status indicators 19 positioned on the shell 15. Such indicators can show the number of puffs taken or remaining from the article, can be indicative of an active or inactive status, can light up in response to a puff, or the like. Although six indicators are illustrated, more or fewer indicators can be present, and the indicators can take on different shapes and orientations and can even be simply an opening in the shell (such as for release of sound when such indicators are present). Such indicators may be lights (e.g., light emitting diodes) that can provide indication of multiple aspects of use of the inventive article. Further, LED indicators may be positioned at the distal end of the smoking article to simulate color changes seen when a conventional cigarette is lit and drawn on by a user. Other indices of operation also are encompassed. For example, visual indicators also may include changes in light color or intensity to show progression of the smoking experience. Tactile indicators and audio indicators similarly are encompassed by the invention. Moreover, combinations of such indicators also may be used in a single article.

As seen in FIG. 1, a reservoir 205 illustrated as a container is shown in proximity to the resistive heating element 50, and a transport element 100 extends from the reservoir 205 and into sufficient proximity with the resistive heating element such that the aerosol precursor composition can be delivered to the resistive heating element for aerosolization. In other embodiments, the reservoir can be a substrate adapted to retain the aerosol precursor composition—e.g., can be a layer of material that is at least partially saturated with the aerosol precursor composition. Such layer can be absorbent, adsorbent, or otherwise porous so as to provide the ability to retain the aerosol precursor composition. As such, the aerosol precursor composition can be characterized as being coated on, adsorbed by, or absorbed in a carrier material (or substrate). The carrier material can be positioned within the article to be in substantial contact with one or more transport elements (e.g., wicks). More particularly, a reservoir can be a woven or non-woven fabric or another mass of fibers or any further material suitable for retaining the aerosol precursor composition (e.g., through absorption, adsorption, capillary action, or the like) and allowing wicking away of the precursor composition for transport to the resistive heating element. Such reservoir layers can be formed of natural fibers, synthetic fibers, or combinations thereof. Non-limiting examples of useful materials include cotton, cellulose, polyesters, polyamides, polylactic acids, combinations thereof, and the like. Similarly, reservoirs can be formed of ceramics, other porous materials, sintered materials, and the like. A smoking article according to the present invention can include one reservoir or a plurality of reservoirs (e.g., two reservoirs, three reservoirs, four reservoirs, or even more). The nature of reservoirs encompassed by the present disclosure is more evident in relation to the discussion of the various figures of the disclosure.

An article according to the present disclosure particularly can be characterized in relation to the combination of the reservoir, transport element, and heating element. The nature of these components as shown in FIG. 1 illustrates only one embodiment, and further embodiments of reservoirs, transport elements, and heaters (particularly in combination) are described in greater particularity herein.

Formed aerosol is drawn by a user through the mouth end 11 of the smoking article 10. The aerosol precursor composition that is aerosolized by the heating of the resistive heating element can be continually replenished (e.g., through wicking or other flow of the aerosol precursor composition from the reservoir to the resistive heating element via the transport element), or specific aliquots of the aerosol precursor composition can be delivered to the resistive heating element on demand. The cycle continues until substantially all of the aerosol precursor composition has been aerosolized.

As seen in FIG. 1, the mouth end 11 of the article 10 can be substantially an open cavity with the certain elements of the smoking article disposed therein. Such open cavity provides a volume for release of the aerosol formed at the resistive heating element. The article also includes a mouth opening 18 in the mouth end 11 to allow for withdrawal of the aerosol from the cavity. Although not expressly shown in the illustration of FIG. 1, the article can include a filter material (such as cellulose acetate or polypropylene) in the mouth end thereof to increase the structural integrity thereof and/or to provide filtering capacity, if desired, and/or to provide resistance to draw. To facilitate air flow through the article, an air intake 17 can be provided and can substantially comprise an aperture in the shell 15 that allows for air flow into the interior of the article. A plurality of air intakes can be provided, and the air intakes can be positioned at any location upstream from the mouth end of the article such that air from the air intake can mingle with and facilitate removal of the formed aerosol from the cavity and through the opening in the mouth end of the article.

In some embodiments, an article as described herein can comprise two units that are attachable and detachable from each other. For example, FIG. 2 shows a smoking article 10 according to one embodiment that is formed of a control body 80 and a cartridge 90. In specific embodiments, the control body may be referred to as being reusable, and the cartridge may be referred to as being disposable. In some embodiments, the entire article may be characterized as being disposable in that the control body may be configured for only a limited number of uses (e.g., until a battery power component no longer provides sufficient power to the article) with a limited number of cartridges and, thereafter, the entire article 10, including the control body, may be discarded. In other embodiments, the control body may have a replaceable battery such that the control body can be reused through a number of battery exchanges and with many cartridges. The article 10 can be rechargeable and thus may be combined with any type of recharging technology, including connection to a typical electrical outlet, connection to a car charger (i.e., cigarette lighter receptacle), and connection to a computer, such as through a USB cable. The article also can be programmable as already discussed above.

The control body 80 and the cartridge 90 are specifically configured so as to engage one another and form an interconnected, functioning device. As illustrated in FIG. 2, the control body 80 includes a proximal attachment end 13 that includes a projection 82 having a reduced diameter in relation to the control body. The cartridge includes a distal attachment end 14 that engages the proximal engagement end of the control body 80 to provide the smoking article 10 in a functioning, usable form. In FIG. 2, the control body projection 82 includes threads that allow the cartridge 90 to screw onto the control body 80 via corresponding threads (not visible in FIG. 2) in the distal attachment end of the cartridge. Thus, the distal attachment end of the cartridge 90 can include an open cavity for receiving the control body projection 82. Although a threaded engagement is illustrated in FIG. 2, it is understood that further means of engagement are encompassed, such as a press-fit engagement, a magnetic engagement, twist-lock engagement, or the like.

In some embodiments, a cartridge according to the disclosure can include one or more electronic control components and/or one or more memory components. Various examples of electronic control components and functions performed thereby that may be used in the devices of the present disclosure are described in U.S. patent application Ser. No. 13/647,000, filed Oct. 8, 2012, which is incorporated herein by reference in its entirety.

As noted above, a smoking article according to the present disclosure can be particularly characterized in relation to the nature of the transport element used to transport one or more components of an aerosol precursor composition to a resistive heating element for vaporization or aerosolization. More specifically, a smoking article according to the present disclosure can include one or more wicks formed of a plurality of individual filaments that are aligned in a defined pattern. For example, the filaments may all be substantially parallel. The individual filaments may be aligned so that substantially all of the filaments have free ends pointed in the same direction or pointed toward a specific point or area within the smoking article. More particularly, the smoking article or a cartridge portion thereof can be characterized as being formed of a hollow shell having the filaments of the wick positioned therein. Specifically, the wick can be positioned within the hollow shell so as to transport an aerosol precursor material inwardly (relative an exterior wall of the hollow shell) toward a central axis extending the length of the hollow shell. Alternatively, the wick can be positioned within the hollow shell so as to transport an aerosol precursor material outwardly (relative to the central axis extending the length of the hollow shell) toward the exterior wall of the hollow shell. Combinations of these configurations also are encompassed. The lengths of the wick filaments can vary, and such variance can be random or can define a specific pattern.

In specific embodiments, a wick for use according to the present disclosure can be formed of a plurality of individual filaments aligned in a brush-like configuration. Accordingly, the individual filaments of the wick each can comprise a first end that is affixed to a holding member and an opposing free end. Such holding member can be an independent member of the present smoking article or a further element of the smoking article can function as the holding member. For example, a reservoir for use in retaining an aerosol precursor composition can also function as the holding member for the individual filaments of the wick. Alternatively, a holding member can be attached to, adjacent to, or embedded in a reservoir to facilitate transport of the aerosol precursor composition (or a component thereof) along the individual wick filaments.

In one aspect of the present disclosure, the individual filaments of the wick can be circumferentially positioned around a segment of an interior surface of the hollow shell. One embodiment of this aspect of the invention is illustrated in FIG. 3 wherein a cartridge 90 of a smoking article includes a wick 300 that is shown as a plurality of individual filaments 301 lining the circumference of the interior of a hollow shell 315. As further discussed herein, the filaments of the wick can be formed of a variety of materials and have various shapes and sizes.

As seen in FIG. 3, the cartridge 90 further includes a heating element 350 that is in electrical contact with electrical leads 351, which are in electrical connection to a battery so as to provide electrical current to the heating element for resistive heating. Although only a single heating element is illustrated, a plurality of heating elements can be used. The heating element can be substantially a resistance wire that can be intertwined with the filaments 301 of the wick 300. More particularly, the heating element can be woven into the wick in a unidirectional or multidirectional manner. In other words, the heating element can be intertwined with the wick such that the heating element forms substantially a unidirectional line around a circumference of the interior of the smoking article; the heating element alternatively can be multidirectional in that it can also extend axially in one or more segments thereof and thus be substantially serpentine in shape around a circumference of the interior of the smoking article.

A reservoir 305 is positioned between the wick 300 and the shell 315 and can retain an aerosol precursor composition or a component thereof. The reservoir can be utilized as a holding member for the wick in that the filaments of the wick are attached to or embedded in the reservoir to form a fluid connection that enables transport of the aerosol precursor composition out of the reservoir. The filaments can be characterized as having a first end that is connected to the holding member and a second end (i.e., an opposing end) that can be free. Transport of the aerosol precursor composition, or a component thereof, therefore can proceed from the first end of the filament toward the second end of the filament. Heating of the filaments by the heating element 350 thus forms a vapor or aerosol that is released into the open central cavity 303 for passage axially along the cartridge 90 to a mouthpiece (not shown) or simply an opening in the shell at an end thereof (e.g., element 18 in FIG. 1).

In the cross-section of FIG. 3, the wick 300 has the appearance of a single row of the filaments 301 encircling the interior of the shell 315, but the smoking article of the disclosure is not so limited. Rather, the wick 300 can have width that can vary from about the width of a single filament to about a width corresponding to about the entire length of a cartridge 90 (see FIG. 2). In certain embodiments, the width of the wick can vary from about 0.5 mm to about 40 mm, about 0.6 mm to about 30 mm, about 0.7 mm to about 20 mm, about 0.8 mm to about 10 mm, about 0.9 mm to about 8 mm, or about 1 mm to about 5 mm. The wick also can be characterized in relation to filament density. Specifically, the wick can have a filament density of about 0.25 filaments per $mm^2$ to about 20 filaments per $mm^2$, about 0.5 filaments per $mm^2$ to about 10 filaments per $mm^2$, or about 1 filament per $mm^2$ to about 5 filaments per $mm^2$. The shape and length of the heating element thus can vary based upon one or more of the number of heating elements present, the width of the wick to be heated by the heating element, and the filament density of the wick.

In some embodiments, a single wick 300 can be present and can have a width as described above. In other embodiments, a plurality of wicks can be included within the shell 315. For example, a plurality of wicks can be used such that the filaments 301 can be circumferentially positioned around a plurality of segments of the interior surface of the shell. One such embodiment is illustrated in FIG. 4.

In the embodiment of FIG. 4, a portion of the shell 315 (partially cut away) of a cartridge 90 includes a first wick 300 formed of a plurality of filaments 301 in a fluid connection with a first reservoir 305 that also functions as a holding member for the filaments. A first heating element 350 in the form of a metal wire is coiled around the interior of the reservoir so as to be intertwined with the wick. Two coils are shown, but more coils can be present, and a plurality of metal wires can be utilized with the same wick. The heating element is connected to electrical leads 351 that are connected to the appropriate wiring (not shown) to form an electrical connection with a battery, such as can be housed in a control element that is adapted for connection to the cartridge. In the same cartridge is a second wick 400 formed of a plurality of filaments 401 in a fluid connection with a second reservoir 405 that also functions as a holding member for the filaments. A second heating element 450 in the form of a metal wire is intertwined with the wick in a serpentine fashion to provide for increased heating density. A single heating element is shown, but a plurality of heating wires can be present for use with the same wick. The second heating element is connected to electrical leads 451 that are connected to the appropriate wiring (not shown) to form an electrical connection with a battery.

As seen in FIG. 3 and FIG. 4, the individual filaments of the wick can be irregularly shaped and can vary in length. In other embodiments, the filaments can be substantially straight and, independently, can be all substantially the same length. When the wick is circumferentially positioned, it can be preferable for the wick length to be of a length that provides for a sufficient volume of the aerosol precursor composition to transport thereby for aerosolization to achieve a desired aerosol volume. Further, the length can be sufficiently short to provide an internal open space within the shell (e.g., within a cartridge) for aerosol formation. For example, the filaments of the wick can have a length of about 0.5 mm to about 5 mm, about 1 mm to about 4.5 mm, or about 1.5 mm to about 4 mm.

In other embodiments, the filaments of the wick used according to the present disclosure can be axially aligned along a length of the hollow shell. In other words, the wick can extend from or near the mouth end to or near the distal attachment end of a cartridge (elements 11 and 14, respectively, of FIG. 2). It is not required, however, for the wick to extend the entire length of the shell of the component in which it is included and can rather extend along only a portion of the length of the shell. For example, an axially aligned wick can have a length of about 2 mm to about 50 mm, about 5 mm to about 45 mm, or about 10 mm to about 40 mm.

In certain embodiments, the axial alignment of the wick can be substantially linear in nature. An exemplary embodiment is shown in FIG. 5 wherein a portion of a cartridge 90 with a partially transparent outer wall 516 is shown with two wicks 500 extending along a partial length of the shell 515. The wicks are in fluid connection with reservoirs 505 that include an aerosol precursor composition or a component thereof, and the reservoirs can function as the holding member for the filaments 501 of the wicks. As illustrated, the wicks are substantially perpendicular to the axis of the reservoir. The present disclosure is not limited to such embodiments, however, and the individual elements of the wick can be present at a variety of angles relative to the reservoir and/or relevant to any further holding member that is present. In specific embodiments, the individual filaments can be at an angle relative to the reservoir and/or holding member of about 10° to about 170°, about 15° to about 165°, about 30° to about 150°, or about 45° to about 135°. Heating elements 550 are shown intermingled with the filaments of the wicks. As can be seen, the heating elements (e.g., resistance heating wires) likewise can be axially aligned along a length of the shell. In the illustrated embodiment, the filaments are substantially uniform in length, but uneven filaments or filaments of irregular length can be used. From the illustrated view, the wick appears to include only a single row of filaments, and such embodiments are encompassed. The present disclosure also encompasses, however, axially aligned wicks that include a plurality of rows of filaments or a plurality of randomly positioned filaments.

As seen in FIG. 6, the axially aligned wicks 600 can be positioned in multiple locations around the interior of the shell 615. Also, as is more evident in the exemplified embodiment, the wicks can be formed of a plurality of rows of individual filaments or a plurality of randomly positioned filaments. Although only a single heating element 650 is shown in each wick, a plurality of heating elements of the same or different configurations can be utilized with each wick. This embodiment also illustrates a holding member 675 that is separate from the reservoir 605. The separate holding member can be formed of any material suitable for securing the individual filaments in position so long as it does not significantly reduce the fluid transport of the aerosol precursor composition from the reservoir to the wick filaments. For example, the holding member can be a woven fabric or a porous, solid substrate, such as a ceramic, or can be formed of another solid material, such as a plastic or metal. Although the reservoir is shown as completely encompassing the inner circumference of the shell, the reservoir can be present only in discrete areas substantially corresponding to the locations of the wicks.

The use of a plurality of individual wicks can be beneficial for separately heating one or more components of the aerosol precursor composition. For example, a flavor and/or a medicament can be retained in a first reservoir associated with a first wick, and a polyol can be retained in a second reservoir associated with a second wick. During use, the control components of the smoking article can be adapted to provide for different heating profiles for the heating members associated with the first and second wicks. For example, the first heating element can be heated to a greater or lesser temperature than the second heating element and/or can be activated for a greater or lesser total heating time than the second heating element. Similarly, the first or second heating element can be activated separately from the other and can be controlled in a different manner than the other. For example, the first heating element can be associated with a wick/reservoir combination that only provides a flavor component, and the second heating element can be associated with a wick/reservoir combination that provides further aerosol precursors. The second heating element thus can be activated responsive to the puff sensor, as described above, and the first heating element can be activated by manual activation to release the flavor only when desired by the user. Moreover, one wick can include a greater number of heating elements than one or more further wicks so that greater overall heating is provided in the wick with the greater number of heating elements. Other combinations of uses of the different wick/reservoir/heater combinations also are encompassed by the present disclosure.

In still other embodiments, the axial alignment of the wick does not necessarily require that wick to be linear in nature. One exemplary, non-linear arrangement is shown in FIG. 7, wherein the axial alignment is substantially helical. In FIG. 7, a cartridge 90 is shown with a partially transparent outer wall 716. In such embodiments, the reservoir 705 can be substantially in a ribbon arrangement wrapped around the interior of the shell 715 to take on a helical shape. The individual filaments 701 of the wick 700 can be arranged on a single side of the reservoir, and a further holding member may be included with the wick/reservoir arrangement if desired. As can be seen in a comparison of FIG. 7 with FIG. 4, the filament density can be varied as necessary to provide desired wicking properties, which can vary based upon the composition being transported and the desired volume (or rate of formation) of vapor to be formed.

Generally, the filaments of the wick can be positioned such that the free ends of the filaments are directed inward toward a central axis of the shell. In some embodiments, the diameter of the wick helix can be reduced so as to allow for the presence of filaments on opposing sides of the reservoir/holding member—i.e., such that filaments are directed outward toward the outer wall of the shell as well as being directed inward, as described above. In still other embodiments, the reservoir/holding member can be substantially circular in cross-section (as opposed to substantially flattened, as shown in FIG. 7), and the filaments can be positioned around the circular reservoir/holding member along any arc sector up to and including 360° (i.e., around a part or the entire circumference of the circular reservoir/holding member). Other geometrical cross-sections (e.g., square or triangular) are also encompassed for the reservoir/holding member, and the wick filaments can be positioned accordingly around a part or the entirety of the reservoir/holding member having a further cross-sectional shape in line with the discussion already provided above. As before, the axially aligned, helical wick can be present along any portion of the length of the shell (e.g., the length of a cartridge).

While the foregoing has described non-limiting examples of wick arrangements that provide primarily (or in part) inward wicking or inward transport of aerosol precursor components relative to the hollow shell, the present disclosure also encompasses outward wicking or outward transport of aerosol precursor components relative to the hollow shell. For example, in some embodiments, the individual filaments of the wick can be positioned about a central axis of the hollow shell such that the free ends of the filaments are directed outward toward an outer wall of the hollow shell. Some embodiments of such outward wicking are captured above in relation to various possible configurations of the wick filaments about a reservoir/holding member having different geometrical cross-sections. In other embodiments, however, an article according to the present disclosure can include a central member extending along the central axis of the hollow shell through at least a portion of the length of the hollow shell. One such embodiment is illustrated in FIG. 8, wherein a wick 800 is formed of a plurality of filaments 801 that are circumferentially positioned around the central member 805 along at least a partial length (or segment) of the central member. In this embodiment, the central member is also the reservoir retaining the liquid aerosol precursor composition. In other embodiments, the central member can be separate and distinct from the reservoir. For example, the central member can be a separate holding member for the wick filaments, or the central member can be a structural component of the cartridge. In such cases, a separate reservoir can be provided in fluid communication with the wick.

In FIG. 8, the filaments encompass a 360° arc sector of the central member reservoir 805. In other embodiments, the filaments can be positioned around the central member reservoir along any arc sector up to and including 360° (i.e., around a part or the entire circumference of the central member reservoir). If desired, the reservoir can be positioned off-center such that an exact center alignment relative to the outer wall of the hollow shell 815 is not required. As needed, one or more positional supports 880 can be present to retain the central member at its location within the hollow shell. The positional supports can take on any arrangement that does not substantially impede flow of air and aerosol or vapor through the hollow shell. As before, a heating member 850 is intertwined with the filaments 801 of the wick 800 and is in electrical connection with the battery or other element that provides electrical energy to the article. Further, a plurality of heating elements can be used.

If desired, a plurality of outwardly wicking wicks can be present on separate segments of the central member and can be separated by spaces where no wicking element is present. Thus, a series of two or more wicks of varying width can be present along the length of a central member present within the hollow shell. In the words, the filaments can be circumferentially positioned around a plurality of segments of the central member, and such segments can be separated by a defined, open space. This arrangement can be similar to the discrete, separate wicks illustrated in FIG. 4 in the inward wicking arrangement.

In further embodiments, the wick filaments can be axially aligned along a length of the central member. One such embodiment is illustrated in FIG. 9, wherein a plurality of wicks (900*a*, 900*b*, 900*c*, 900*d*) each formed of a plurality of filaments 901 are positioned around discrete arc sectors of the central member (or central reservoir) 905. As illustrated in FIG. 9, the central member 905 can be formed of a plurality of discrete reservoirs (906, 907, 908, 909) corresponding to the discrete wicks, and the discrete reservoirs can retain different materials for aerosolization. The reservoir can be divided into more or fewer sections as desired, and two or more of the reservoirs can include compositions of overlapping components. Alternately, the central reservoir can be a singular member, and one wick or a plurality of wicks can extend radially therefrom. Each wick can have an associated heating member (950*a*, 950*b*, 950*c*, 950*d*). A plurality of heating members can be used with one or more of the wicks. As before, the presence of a plurality of wicks and a plurality of heaters can allow for separate heating of the separate wicks to provide of a variety of heating profiles wherein the aerosol precursor composition (or components thereof) can be heated differently to achieve a number of programmable aerosol compositions.

Yet another embodiment of the disclosure is shown in FIG. 10, wherein the axial alignment of the wick 1000 with its individual filaments 1001 is shown to be substantially a straight line. Moreover, the filaments can be aligned in a plurality of rows along the length of the central member (or central reservoir) 10005. The wick (and the central member) can extend along all or part of the length of the hollow shell 1015 of the cartridge 90 or other element of an article according to the disclosure. In the same manner as seen in FIG. 9, the plurality of rows of the filaments can be present at one or more arc sectors of the central member. In other embodiments, the central member can take on a different geometrical cross-section, such as square or triangular), and a plurality of wicks can be present on one or more sides of the central member. Moreover, as illustrated in relation to FIG. 7, the outwardly wicking, axially aligned wick can have an axial alignment that is substantially helical around the central member.

The filaments used in a wick according to the present disclosure can be formed of any material that is thermally stable and that provides sufficient wicking action to transport one or more components of the aerosol precursor composition along the length of the filament. Non-limiting examples include natural and synthetic fibers, such as cotton, cellulose, polyesters, polyamides, polylactic acids, glass fibers, combinations thereof, and the like. Other exemplary materials that can be used in wicks include metals, ceramics, and carbonized filaments (e.g., a material formed of a carbonaceous material that has undergone calcining to drive off non-carbon components of the material).

The filaments (or the wick generally) can be coated with materials that alter the capillary action of the filaments—i.e., to increase (or decrease, if desired) the wicking action of the filament. Also, fiber material selection can be utilized to increase or decrease wicking action and thus control the wicking rate of a specific component of the aerosol precursor composition. Wicking also can be customized through choice of the dimensions of the fibers used in the wicks and the overall dimensions of the wick, including wick length and wick diameter.

The filaments used in forming wicks can have specific cross-sectional shape and/or can be grooved so as to alter the capillary action of the fibers. Typical filaments have a substantially round cross-section, and altering fiber cross-section shape can increase the surface area per denier of the fiber and thus improve wicking along the filament. For example, a filament can be formed with longitudinal grooves that are intended to facilitate wicking, such as a 4DG fiber (available from Fiber Innovation Technology) and winged fibers (available from Alasso Industries). Filaments formed with an "X" or "Y" shaped cross-section similarly can provide desirable wicking properties.

Filaments useful according to the present disclosure also can include filaments having physical alterations thereof. For example, filaments can be scored or partially cut along the length thereof so as to increase the overall exposed surface area of the filament. Such scores or cuts can be made at any angle greater than 0° and less than 180° relative to the axis of the filament.

In other embodiments, at least a portion of a filament utilized in a wick can be designed to promote radial wicking. Continuous filament fibers, such as fiberglass, tend to promote wicking primarily along the axis of the filament—i.e., axial wicking. Through appropriate design, the filament also can be caused to promote radial wicking—i.e., outward from the axis of the filament. For example, radial wicking can be facilitated through use of filaments having a fibrillated fiber surface. Such design particularly can be useful in the area of the filaments that are in proximity to or in contact with the heater as it can cause more of the precursor composition to be available for aerosolization in the specific area of the heater. A similar effect can be achieved such as through the use of particles or beads that can be sintered or otherwise interconnected to provide a continuous wick structure.

Filaments used in forming wicks can be provided singly or can be bundled (including meshes and braids). In other words, a filament can be a single fiber, or a filament can be formed of a group of combined fibers that provide a larger mass. Porosity of the filaments used in the wick also can be controlled to alter the capillary action and can include controlling average pore size and total porosity, controlling filament geometry, controlling overall wick shape, and controlling surface characteristics. Separate filaments also can have different lengths. Varying the nature of the filaments can be useful to customize vapor formation. For example, filaments with greater wicking ability can be used to transport a component of an aerosol precursor composition that is desired to be vaporized in a high amount, and filaments with a reduced wicking ability can be sued to transport a component of an aerosol precursor composition that is desired to be vaporized in a lesser amount.

The type of material used to form the individual filaments of the wicks also can be customized to transport specific types of compounds. For example, one or more wicks can be formed of filaments utilizing hydrophobic materials so as to preferentially wick hydrophobic liquids. Further, one or more wicks can be formed of filaments utilizing hydrophilic materials so as to preferentially wick hydrophilic liquids. Moreover, one or more wicks can include filaments formed of materials that are neither hydrophilic nor hydrophobic, such as natural materials, so as to preferentially wick liquids that are neither significantly polar nor significantly non-polar.

The aerosol precursor composition utilized in an article according to the present disclosure can be formed of a variety of individual components. Preferably, the aerosol precursor composition can include at least one aerosol forming material, such as a polyol. The aerosol precursor composition further can include a number of additional components, including flavorings and medicaments.

In certain embodiments, a smoking article according to the present disclosure can include tobacco, a tobacco component, or a tobacco-derived material (i.e., a material that is found naturally in tobacco that may be isolated directly from the tobacco or synthetically prepared). The tobacco that is employed can include, or can be derived from, tobaccos such as flue-cured tobacco, burley tobacco, Oriental tobacco, Maryland tobacco, dark tobacco, dark-fired tobacco and Rustica tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al., U.S. Pat. No. 7,011,096 to Li et al.; U.S. Pat. No. 7,017,585 to Li et al.; U.S. Pat. No. 7,025,066 to Lawson et al.; US Pat. App. Pub. No. 2004/0255965 to Perfetti et al.; PCT Pub. WO 02/37990 to Bereman; and Bombick et al., *Fund. Appl. Toxicol.,* 39, p. 11-17 (1997); the disclosures of which are incorporated herein by reference in their entireties.

The tobacco that is incorporated within the smoking article can be employed in various forms; and combinations of various forms of tobacco can be employed, or different forms of tobacco can be employed at different locations within the smoking article. For example, the tobacco can be employed in the form of a tobacco extract. See, for example, U.S. Pat. No. 7,647,932 to Cantrell et al. and US Pat. Pub. No. 2007/0215167 to Crooks et al., the disclosures of which are incorporated herein by reference in their entireties.

The smoking article can incorporate tobacco additives of the type that are traditionally used for the manufacture of tobacco products. Those additives can include the types of materials used to enhance the flavor and aroma of tobaccos used for the production of cigars, cigarettes, pipes, and the like. For example, those additives can include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials include water, sugars and syrups (e.g., sucrose, glucose and high fructose corn syrup), humectants (e.g. glycerin or propylene glycol), and flavoring agents (e.g., cocoa and licorice). Those added components also include top dressing materials (e.g., flavoring materials, such as menthol). See, for example, U.S. Pat. No. 4,449,541 to Mays et al., the disclosure of which is incorporated herein by reference in its entirety. Further materials that can be added include those disclosed in U.S. Pat. No. 4,830,028 to Lawson et al. and US Pat. Pub. No. 2008/0245377 to Marshall et al., the disclosures of which are incorporated herein by reference in their entireties.

Various manners and methods for incorporating tobacco into smoking articles, and particularly smoking articles that are designed so as to not purposefully burn virtually all of the tobacco within those smoking articles, are set forth in U.S. Pat. No. 4,947,874 to Brooks et al.; U.S. Pat. No. 7,647,932 to Cantrell et al.; US Pat. App. Pub. No. 2005/0016549 to Banerjee et al.; and US Pat. App. Pub. No. 2007/0215167 to Crooks et al.; the disclosures of which are incorporated herein by reference in their entireties.

Further tobacco materials, such as a tobacco aroma oil, a tobacco essence, a spray dried tobacco extract, a freeze dried tobacco extract, tobacco dust, or the like may be included in the vapor precursor or aerosol precursor composition. As used herein, the term "tobacco extract" means components separated from, removed from, or derived from, tobacco using tobacco extraction processing conditions and techniques. Purified extracts of tobacco or other botanicals specifically can be used. Typically, tobacco extracts are obtained using solvents, such as solvents having an aqueous nature (e.g., water) or organic solvents (e.g., alcohols, such as ethanol or alkanes, such as hexane). As such, extracted tobacco components are removed from tobacco and separated from the unextracted tobacco components; and for extracted tobacco components that are present within a solvent, (i) the solvent can be removed from the extracted tobacco components, or (ii) the mixture of extracted tobacco components and solvent can be used as such. Exemplary types of tobacco extracts, tobacco essences, solvents, tobacco extraction processing conditions and techniques, and tobacco extract collection and isolation procedures, are set forth in Australia Pat. No. 276,250 to Schachner; U.S. Pat. No. 2,805,669 to Meriro; U.S. Pat. No. 3,316,919 to Green et al.; U.S. Pat. No. 3,398,754 to Tughan; U.S. Pat. No. 3,424,171 to Rooker; U.S. Pat. No. 3,476,118 to Luttich; U.S. Pat. No. 4,150,677 to Osborne; U.S. Pat. No. 4,131,117 to Kite; U.S. Pat. No. 4,506,682 to Muller; U.S. Pat. No. 4,986,286 to Roberts et al.; U.S. Pat. No. 5,005,593 to Fagg; U.S. Pat. No. 5,065,775 to Fagg; U.S. Pat. No. 5,060,669 to White et al.; U.S. Pat. No. 5,074,319 to White et al.; U.S. Pat. No. 5,099,862 to White et al.; U.S. Pat. No. 5,121,757 to White et al.; U.S. Pat. No. 5,131,415 to Munoz et al.; U.S. Pat. No. 5,230,354 to Smith et al.; U.S. Pat. No. 5,235,992 to Sensabaugh; U.S. Pat. No. 5,243,999 to Smith; U.S. Pat. No. 5,301,694 to Raymond; U.S. Pat. No. 5,318,050 to Gonzalez-Parra et al.; U.S. Pat. No. 5,435,325 to Clapp et al.; and U.S. Pat. No. 5,445,169 to Brinkley et al.; the disclosures of which are incorporated herein by reference in their entireties.

The aerosol precursor or vapor precursor composition preferentially can include a polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some embodiments, an aerosol precursor composition can produce a visible aerosol upon the application of sufficient heat thereto (and cooling with air, if necessary), and the aerosol precursor composition can produce an aerosol that can be considered to be "smoke-like." In other embodiments, the aerosol precursor composition can produce an aerosol that can be substantially non-visible but can be recognized as present by other characteristics, such as flavor or texture. Thus, the nature of the produced aerosol can vary depending upon the specific components of the aerosol precursor composition. The aerosol precursor composition can be chemically simple relative to the chemical nature of the smoke produced by burning tobacco.

Aerosol precursor compositions can include further liquid materials, such as water. For example, aerosol precursor compositions can incorporate mixtures of glycerin and water, or mixtures of propylene glycol and water, or mixtures of propylene glycol and glycerin, or mixtures of propylene glycol, glycerin, and water. Exemplary aerosol precursor compositions also include those types of materials incorporated within devices available through Atlanta Imports Inc., Acworth, Ga., USA., as an electronic cigar having the brand name E-CIG, which can be employed using associated Smoking Cartridges Type C1a, C2a, C3a, C4a, C1b, C2b, C3b and C4b; and as Ruyan Atomizing Electronic Pipe and Ruyan Atomizing Electronic Cigarette from Ruyan SBT Technology and Development Co., Ltd., Beijing, China.

The aerosol precursor composition used in the disclosed smoking article further can comprise one or more flavors, medicaments, or other inhalable materials. For example, liquid nicotine can be used. Such further materials can comprise one or more components of the aerosol precursor or vapor precursor composition. Thus, the aerosol precursor or vapor precursor composition can be described as comprising an inhalable substance. Such inhalable substance can include flavors, medicaments, and other materials as discussed herein. Particularly, an inhalable substance delivered using a smoking article according to the present invention can comprise a tobacco component or a tobacco-derived material. Alternately, the flavor, medicament, or other inhalable material can be provided separate from other aerosol precursor components—e.g., in a reservoir. As such, defined aliquots of the flavor, medicament, or other inhalable material may be separately or simultaneously delivered to the resistive heating element to release the flavor, medicament, or other inhalable material into an air stream to be inhaled by a user along with the further components of the aerosol precursor or vapor precursor composition.

A wide variety of types of flavoring agents, or materials that alter the sensory or organoleptic character or nature of the mainstream aerosol of the smoking article, can be employed. Such flavoring agents can be provided from sources other than tobacco, can be natural or artificial in nature, and can be employed as concentrates or flavor packages. Of particular interest are flavoring agents that are applied to, or incorporated within, those regions of the smoking article where aerosol is generated. Again, such agents can be supplied directly to the resistive heating element or may be provided on a substrate as already noted above. Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, also can be employed. Flavoring agents also can include acidic or basic characteristics (e.g., organic acids, such as levulinic acid, succinic acid, lactic acid, and pyruvic acid). The flavoring agents can be combined with the aerosol-generating material if desired. Exemplary plant-derived compositions that may be used are disclosed in U.S. application Ser. No. 12/971,746 to Dube et al. and U.S. application Ser. No. 13/015,744 to Dube et al., the disclosures of which are incorporated herein by reference in their entireties.

Organic acids particularly may be incorporated into the aerosol precursor to provide desirable alterations to the flavor, sensation, or organoleptic properties of medicaments, such as nicotine, that may be combined with the aerosol precursor. For example, organic acids, such as levulinic acid, succinic acid, lactic acid, and pyruvic acid, may be included in the aerosol precursor with nicotine in amounts up to being equimolar (based on total organic acid content) with the nicotine. Any combination of organic acids can be used. For example, the aerosol precursor can include about 0.1 to about 0.5 moles of levulinic acid per one mole of nicotine, about 0.1 to about 0.5 moles of pyruvic acid per one mole of nicotine, about 0.1 to about 0.5 moles of lactic acid per one mole of nicotine, or combinations thereof, up to a concentration wherein the total amount of organic acid present is equimolar to the total amount of nicotine present in the aerosol precursor.

In embodiments of the aerosol precursor material that contain a tobacco extract, including pharmaceutical grade nicotine derived from tobacco, it is advantageous for the tobacco extract to be characterized as substantially free of compounds collectively known as Hoffmann analytes, including, for example, tobacco-specific nitrosamines (TSNAs), including N'-nitrosonornicotine (NNN), (4-methylnitrosamino)-1-(3-pyridyl)-1-butanone (NNK), N'-nitrosoanatabine (NAT), and N'-nitrosoanabasine (NAB); polyaromatic hydrocarbons (PAHs), including benz[a]anthracene, benzo[a]pyrene, benzo[b]fluoranthene, benzo[k]fluoranthene, chrysene, dibenz[a,h]anthracene, and indeno[1,2,3-cd]pyrene, and the like. In certain embodiments, the aerosol precursor material can be characterized as completely free of any Hoffmann analytes, including TSNAs and PAHs. Embodiments of the aerosol precursor material may have TSNA levels (or other Hoffmann analyte levels) in the range of less than about 5 ppm, less than about 3 ppm, less than about 1 ppm, or less than about 0.1 ppm, or even below any detectable limit. Certain extraction processes or treatment processes can be used to achieve reductions in Hoffmann analyte concentration. For example, a tobacco extract can be brought into contact with an imprinted polymer or non-imprinted polymer such as described, for example, in US Pat. Pub. Nos. 2007/0186940 to Bhattacharyya et al; 2011/0041859 to Rees et al.; and 2011/0159160 to Jonsson et al; and U.S. patent application Ser. No. 13/111,330 to Byrd et al., filed May 19, 2011, all of which are incorporated herein by reference. Further, the tobacco extract could be treated with ion exchange materials having amine functionality, which can remove certain aldehydes and other compounds. See, for example, U.S. Pat. No. 4,033,361 to Horsewell et al. and U.S. Pat. No. 6,779,529 to Figlar et al., which are incorporated herein by reference in their entireties.

The aerosol precursor composition may take on a variety of conformations based upon the various amounts of materials utilized therein. For example, a useful aerosol precursor composition may comprise up to about 98% by weight up to about 95% by weight, or up to about 90% by weight of a polyol. This total amount can be split in any combination between two or more different polyols. For example, one polyol can comprise about 50% to about 90%, about 60% to about 90%, or about 75% to about 90% by weight of the aerosol precursor, and a second polyol can comprise about 2% to about 45%, about 2% to about 25%, or about 2% to about 10% by weight of the aerosol precursor. A useful aerosol precursor also can comprise up to about 25% by weight, about 20% by weight or about 15% by weight water—particularly about 2% to about 25%, about 5% to about 20%, or about 7% to about 15% by weight water. Flavors and the like (which can include medicaments, such as nicotine) can comprise up to about 10%, up to about 8%, or up to about 5% by weight of the aerosol precursor.

As a non-limiting example, an aerosol precursor according to the invention can comprise glycerol, propylene glycol, water, nicotine, and one or more flavors. Specifically, the glycerol can be present in an amount of about 70% to about 90% by weight, about 70% to about 85% by weight, or about 75% to about 85% by weight, the propylene glycol can be present in an amount of about 1% to about 10% by weight, about 1% to about 8% by weight, or about 2% to about 6% by weight, the water can be present in an amount of about 10% to about 20% by weight, about 10% to about 18% by weight, or about 12% to about 16% by weight, the nicotine can be present in an amount of about 0.1% to about 5% by weight, about 0.5% to about 4% by weight, or about 1% to about 3% by weight, and the flavors can be present in an amount of up to about 5% by weight, up to about 3% by weight, or up to about 1% by weight, all amounts being based on the total weight of the aerosol precursor. One specific, non-limiting example of an aerosol precursor comprises about 75% to about 80% by weight glycerol, about 13% to about 15% by weight water, about 4% to about 6% by weight propylene glycol, about 2% to about 3% by weight nicotine, and about 0.1% to about 0.5% by weight flavors. The nicotine, for example, can be a from a tobacco extract.

The amount of aerosol precursor composition that is used within the smoking article is such that the article exhibits acceptable sensory and organoleptic properties, and desirable performance characteristics. For example, it is highly preferred that sufficient aerosol precursor composition components, such as glycerin and/or propylene glycol, be employed in order to provide for the generation of a visible mainstream aerosol that in many regards resembles the appearance of tobacco smoke. Typically, the amount of aerosol-generating material incorporated into the smoking article is in the range of about 1.5 g or less, about 1 g or less, or about 0.5 g or less. The amount of aerosol precursor composition can be dependent upon factors such as the number of puffs desired per cartridge used with the smoking article. It is desirable for the aerosol precursor composition not to introduce significant degrees of unacceptable off-taste, filmy mouth-feel, or an overall sensory experience that is significantly different from that of a traditional type of cigarette that generates mainstream smoke by burning tobacco cut filler. The selection of the particular aerosol-generating material and reservoir material, the amounts of those components used, and the types of tobacco material used, can be altered in order to control the overall chemical composition of the mainstream aerosol produced by the smoking article.

Typically, the aerosol precursor composition utilized in the smoking article will be formed of a first component and at least a second, separate component. Thus, the aerosol precursor composition can be formed of a plurality of components, such as two separate components, three separate components, four separate components, five separate components, and so on. In various embodiments, separate components of the aerosol precursor composition can be transported by separate wicks or separate and defined groups of filaments in a single wick. Separate transport can apply in this regard to each individual component of the aerosol precursor composition or any combination of the individual components. For example, a single reservoir can be segmented and different components of the aerosol precursor composition can be housed in the different segments for transport by the wick filaments in fluid connection with the specific segment. Alternatively, different reservoirs with different wicks combined therewith can be utilized. Various combinations of one or more reservoirs, one or more transport elements, and one or more heater elements, all having various designs and formed of various materials, may be used according to the present disclosure.

Beneficially, utilizing separate transport of separate components of the aerosol precursor composition to separate heating elements can allow for the separate components to be heated to different temperatures to provide a more consistent aerosol for draw by a user. Although the aerosolization temperature of separate heaters can be substantially the same, in some embodiments, the aerosolization temperature of the separate heaters can differ by 2° C. or greater, 5° C. or greater, 10° C. or greater, 20° C. or greater, 30° C. or greater, or 50° C. or greater.

Although a variety of materials for use in a smoking article according to the present invention have been described above—such as heaters, batteries, capacitors, switching components, reservoirs, dispensers, aerosol precursors, and the like, the invention should not be construed as being limited to only the exemplified embodiments. Rather, one of skill in the art can recognize based on the present disclosure similar components in the field that may be interchanged with any specific component of the present invention. For example, U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; US 2009/0320863 by Fernando et al. discloses computer interfacing means for smoking devices to facilitate charging and allow computer control of the device; US 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; US Pat. Pub. Nos. 2009/0095311, 2006/0196518, 2009/0126745, and 2009/0188490 to Hon; US Pat. Pub. No. 2009/0272379 to Thorens et al.; US Pat. Pub. Nos. 2009/0260641 and 2009/0260642 to Monsees et al.; US Pat. Pub. Nos. 2008/0149118 and 2010/0024834 to Oglesby et al.; US Pat. Pub. No. 2010/0307518 to Wang; and WO 2010/091593 to Hon. A variety of the materials disclosed by the foregoing documents may be incorporated into the present devices in various embodiments, and all of the foregoing disclosures are incorporated herein by reference in their entireties.

Although an article according to the invention may take on a variety of embodiments, the use of the article by a consumer will be similar in scope. In particular, the article can be provided as a single unit or as a plurality of components that are combined by the consumer for use and then are dismantled by the consumer thereafter. Generally, a smoking article according to the invention can comprise a first unit that is engagable and disengagable with a second unit, the first unit comprising the resistive heating element, and the second unit comprising the electrical power source. In some embodiments, the second unit further can comprise one or more control components that actuate or regulate current flow from the electrical power source. The first unit can comprise a distal end that engages the second unit and an opposing, proximate end that includes a mouthpiece (or simply the mouth end) with an opening at a proximate end thereof. The first unit can comprise an air flow path opening into the mouthpiece of the first unit, and the air flow path can provide for passage of aerosol formed from the resistive heating element into the mouthpiece. In preferred embodiments, the first unit can be disposable. Likewise, the second unit can be reusable.

More specifically, a smoking article according to the invention can have a reusable control body that is substantially cylindrical in shape having a connecting end and an opposing, closed end. The closed end of the control housing may include one or more indicators of active use of the article. The article further can comprise a cartridge with a connecting end that engages the connecting end of the control body and with an opposing, mouth end. To use the article, the consumer can connect a connecting end of the cartridge to the connecting end of the control body or otherwise combine the cartridge with the control body so that the article is operable as discussed herein. In some embodiments, the connecting ends of the control body and the cartridge can be threaded for a screw-type engagement. In other embodiments, the connecting ends can have a press-fit engagement.

During use, the consumer initiates heating of the resistive heating element, the heat produced by the resistive heating element aerosolizes the aerosol precursor composition and, optionally, further inhalable substances. Such heating releases at least a portion of the aerosol precursor composition in the form of an aerosol (which can include any further inhalable substances included therewith), and such aerosol is provided within a space inside the cartridge that is in fluid communication with the mouth end of the cartridge. When the consumer inhales on the mouth end of the cartridge, air is drawn through the cartridge, and the combination of the drawn air and the aerosol is inhaled by the consumer as the drawn materials exit the mouth end of the cartridge (and any optional mouthpiece present) into the mouth of the consumer. To initiate heating, the consumer may actuate a pushbutton, capacitive sensor, or similar component that causes the resistive heating element to receive electrical energy from the battery or other energy source (such as a capacitor). The electrical energy may be supplied for a pre-determined length of time or may be manually controlled. Preferably, flow of electrical energy does not substantially proceed in between puffs on the article (although energy flow may proceed to maintain a baseline temperature greater than ambient temperature—e.g., a temperature that facilitates rapid heating to the active heating temperature).

In further embodiments, heating may be initiated by the puffing action of the consumer through use of various sensors, as otherwise described herein. Once the puff is discontinued, heating will stop or be reduced. When the consumer has taken a sufficient number of puffs so as to have released a sufficient amount of the inhalable substance (e.g., an amount sufficient to equate to a typical smoking experience), the cartridge can be removed from the control housing and discarded. Indication that the cartridge is spent (i.e., the aerosol precursor composition has been substantially removed by the consumer) can be provided. In some embodiments, a single cartridge can provide more than a single smoking experience and thus may provide a sufficient content of aerosol precursor composition to simulate as much as full pack of conventional cigarettes or even more.

The foregoing description of use of the article can be applied to the various embodiments described through minor modifications, which can be apparent to the person of skill in the art in light of the further disclosure provided herein. The above description of use, however, is not intended to limit the use of the inventive article but is provided to comply with all necessary requirements of disclosure of the present invention.

In certain embodiments, a smoking article according to the present disclosure can be characterized as a disposable article (or as including a disposable unit—e.g., a disposable cartridge). Accordingly, it can be desirable for the reservoir containing the aerosol precursor composition in such embodiments to include a sufficient amount of aerosol precursor composition so that a consumer can obtain more than a single use of the article. For example, the article can include sufficient aerosolizable and/or inhalable materials such that the article can provide a number of puffs substantially equivalent to the number of puffs (of about two to four seconds duration) available from a plurality of conventional cigarettes—e.g., 2 or more, 5 or more, 10 or more, or 20 or more conventional cigarettes. More particularly, a disposable, single unit article according to the present disclosure can provide about 20 or more, about 50 or more, or about 100 or more puffs, a single puff being measured as otherwise described herein.

In preferred embodiments, the article can take on a size that is comparative to a cigarette or cigar shape. Thus, the article may have a diameter of about 5 mm to about 25 mm, about 5 mm to about 20 mm, about 6 mm to about 15 mm, or about 6 mm to about 10 mm. Such dimension may particularly correspond to the outer diameter of the shell. In addition to the foregoing, the control body and cartridge can be characterized in relation to overall length. For example, the control body can have a length of about 50 mm to about 110 mm, about 60 mm to about 100 mm, or about 65 mm to about 95 mm. The cartridge can have a length of about 20 mm to about 60 mm, about 25 mm to about 55 mm, or about 30 mm to about 50 mm. The overall length of the combined cartridge and control body (or the overall length of a smoking article according to the invention formed of a single, unitary shell) can be approximately equal to or less than the length of a typical cigarette—e.g., about 70 mm to about 130 mm, about 80 mm to about 125 mm, or about 90 mm to about 120 mm.

In specific embodiments, a disposable unit or cartridge according to the invention can be substantially identical to a cartridge as described above in relation to the appended figures. Thus, a disposable cartridge can comprise a substantially tubular shaped cartridge shell having a distal attachment end configured to engage a reusable smoking article or medicament delivery article and an opposing mouth end configured to allow passage of a formed vapor and any further inhalable materials to a consumer. The cartridge shell can define an interior cartridge space that includes additional cartridge components, particularly inwardly and/or outwardly wicking wicks formed of a plurality of filaments in fluid communication with a reservoir.

Although the various figures described herein illustrate the control body and the cartridge in a working relationship, it is understood that the control body and the cartridge can exist as individual devices. Accordingly, any discussion otherwise provided herein in relation to the components in combination also should be understood as applying to the control body and the cartridge as individual and separate components.

In another aspect, the invention can be directed to kits that provide a variety of components as described herein. For example, a kit can comprise a control body with one or more cartridges. A kit further can comprise a control body with one or more charging components. A kit further can comprise a control body with one or more batteries. A kit further may comprise a control body with one or more cartridges and one or more charging components and/or one or more batteries. In further embodiments, a kit may comprise a plurality of cartridges. A kit further may comprise a plurality of cartridges and one or more batteries and/or one or more charging components. The inventive kits further can include a case (or other packaging, carrying, or storage component) that accommodates one or more of the further kit components. The case could be a reusable hard or soft container. Further, the case could be simply a box or other packaging structure.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A smoking article comprising:

a hollow shell comprising an exterior wall with a mouthend and including a wick formed of a plurality of individual filaments aligned in a brush-like configuration, the individual filaments each comprising a first end that is affixed to a holding member and an opposing free end, and the mouthend of the hollow shell being configured for draw of formed aerosol by a user; and an aerosol precursor composition, wherein:

the wick is positioned within the hollow shell such that the free ends of the filaments are directed toward an interior of the hollow shell and so as to transport the aerosol precursor material inward, relative to the exterior wall, from the holding member toward a central axis extending the length of the hollow shell; or the wick is positioned within the hollow shell such that the free ends of the filaments are directed outward from the central axis extending the length of the hollow shell and so as to transport the aerosol precursor material outward from the central axis toward the exterior wall of the hollow shell.

2. The smoking article of claim 1, wherein the filaments are circumferentially positioned around a segment of an interior surface of the hollow shell.

3. The smoking article of claim 2, wherein the filaments are circumferentially positioned around a plurality of segments of the interior surface of the hollow shell.

4. The smoking article of claim 1, wherein the filaments are axially aligned along a length of the hollow shell.

5. The smoking article of claim 4, wherein the axial alignment is substantially a straight line.

6. The smoking article of claim 4, wherein the axial alignment is substantially helical.

7. The smoking article of claim 4, wherein the filaments are aligned in a plurality of rows.

8. The smoking article of claim 1, further comprising a central member extending along the central axis through at least a portion of the length of the hollow shell.

9. The smoking article of claim 8, wherein the filaments are circumferentially positioned around a segment of the central member.

10. The smoking article of claim 9, wherein the filaments are circumferentially positioned around a plurality of segments of the central member.

11. The smoking article of claim 8, wherein the filaments are axially aligned along a length of the central member.

12. The smoking article of claim 11, wherein the axial alignment is substantially a straight line.

13. The smoking article of claim 11, wherein the axial alignment is substantially helical.

14. The smoking article of claim 11, wherein the filaments are aligned in a plurality of rows.

15. The smoking article of claim 1, wherein the filaments are substantially uniform in length.

16. The smoking article of claim 1, wherein the filaments are variable in length.

17. The smoking article of claim 16, wherein the filament lengths define a pattern.

18. The smoking article of claim 1, wherein the wick is operatively positioned within the smoking article to be substantially in contact with the aerosol precursor composition.

19. The smoking article of claim 1, wherein the aerosol precursor composition is in the form of a liquid or gel at ambient conditions.

20. The smoking article of claim 1, wherein the holding member is a reservoir, and wherein the aerosol precursor composition is retained by the reservoir.

21. The smoking article of claim 20, wherein the reservoir is provided in a plurality of segments.

22. The smoking article of claim 21, wherein the wick is provided in a plurality of segments.

23. The smoking article of claim 1, wherein the article comprises a reservoir that is distinct from the holding member, and wherein the aerosol precursor composition is retained by the reservoir.

24. The smoking article of claim 1, further comprising a heater.

25. The smoking article of claim 24, wherein the heater comprises a resistance heating wire.

26. The smoking article of claim 25, wherein the heating wire is at least partially intertwined with the filaments of the wick.

27. The smoking article of claim 25, wherein the heating wire is woven into the filaments of the wick.

28. The smoking article of claim 25, wherein the heater comprises a plurality of resistance heating wires.

29. The smoking article of claim 28, wherein a first heater wire is in contact with a first segment of the wick and wherein a second heater wire in contact with a second segment of the wick.

30. The smoking article of claim 29, wherein the first segment of the wick is adapted to transport a first aerosol precursor material and the second segment of the wick is adapted to transport a second aerosol precursor material.

31. The smoking article of claim 29, wherein the first heater wire and the second heater wire provide differing heating modes.

32. The smoking article of claim 31, wherein the heating modes comprise one or more of heating temperature, heating rate, and total heating time.

33. The smoking article of claim 1, further comprising an electrical power source.

34. The smoking article of claim 33, further comprising a control component.

35. The smoking article of claim 34, wherein the control component comprises a puff-actuated sensor.

36. The smoking article of claim 34, wherein the control component comprises a capacitive sensor.

* * * * *